US010821570B2

(12) United States Patent
Tomonaga et al.

(10) Patent No.: US 10,821,570 B2
(45) Date of Patent: Nov. 3, 2020

(54) GRINDER

(71) Applicant: MAKITA CORPORATION, Anjo-shi, Aichi (JP)

(72) Inventors: Akira Tomonaga, Anjo (JP); Katsuhito Fujinami, Anjo (JP); Ryo Imuta, Anjo (JP); Masatoshi Nakahama, Anjo (JP); Akira Mizutani, Anjo (JP); Takahiro Kawakami, Anjo (JP); Hideharu Muto, Anjo (JP); Junya Ishikawa, Anjo (JP); Ken Goto, Anjo (JP)

(73) Assignee: MAKITA CORPORATION, Anjo (JP)

( * ) Notice: Subject to any disclaimer, the term of this patent is extended or adjusted under 35 U.S.C. 154(b) by 298 days.

(21) Appl. No.: 15/762,608

(22) PCT Filed: Sep. 23, 2016

(86) PCT No.: PCT/JP2016/078088
§ 371 (c)(1),
(2) Date: Mar. 23, 2018

(87) PCT Pub. No.: WO2017/051893
PCT Pub. Date: Mar. 30, 2017

(65) Prior Publication Data

US 2018/0281146 A1 Oct. 4, 2018

(30) Foreign Application Priority Data

Sep. 25, 2015 (JP) ..... 2015-188012

(51) Int. Cl.
*B24B 23/02* (2006.01)
*B24B 55/05* (2006.01)
*B24B 49/10* (2006.01)

(52) U.S. Cl.
CPC ..... *B24B 23/022* (2013.01); *B24B 23/02* (2013.01); *B24B 49/10* (2013.01); *B24B 55/05* (2013.01); *B24B 55/052* (2013.01)

(58) Field of Classification Search
CPC ..... B24B 23/022; B24B 23/02; B24B 49/10; B24B 55/05; B24B 55/052
(Continued)

(56) References Cited

U.S. PATENT DOCUMENTS 8,151,679 B2 * 4/2012 Bohne ..... B24B 23/04 83/698.11
8,905,822 B2 * 12/2014 Meyer ..... B24B 23/028 451/344
(Continued)

FOREIGN PATENT DOCUMENTS

JP S51-114787 U 9/1976
JP S58-055847 U 4/1983
(Continued)

OTHER PUBLICATIONS

Mar. 27, 2018 International Preliminary Report on Patentability issued in Patent Application No. PCT/JP2016/078088.
(Continued)

*Primary Examiner* — George B Nguyen
(74) *Attorney, Agent, or Firm* — Oliff PLC

(57) ABSTRACT

A grinder according to one aspect of the present disclosure includes a motor, a housing for housing the motor, a spindle protruding from the housing and configured to be driven to be rotated by the motor, a wheel cover configured to cover a part of a tip end tool attached to the spindle, a detector configured to detect the wheel cover, and a controller configured to stop or restrict the spindle being driven by the motor in response to non-detection of the wheel cover by the detector.

14 Claims, 29 Drawing Sheets

(58) Field of Classification Search
USPC ..... 451/359
See application file for complete search history.

(56) References Cited

U.S. PATENT DOCUMENTS

| | | | | |
|---|---|---|---|---|
| 2003/0176147 | A1 | 9/2003 | Krondorfer et al. | |
| 2008/0014844 | A1* | 1/2008 | Pontieri | B24B 23/022 451/359 |
| 2016/0273581 | A1* | 9/2016 | Wallmeier | F16C 19/525 |

FOREIGN PATENT DOCUMENTS

| | | | |
|---|---|---|---|
| JP | 2002-079413 | A | 3/2002 |
| JP | 2004-513800 | A | 5/2004 |
| JP | 2013-078823 | A | 5/2013 |
| JP | 2013-226617 | A | 11/2013 |

OTHER PUBLICATIONS

Nov. 22, 2016 International Search Report issued in Patent Application No. PCT/JP2016/078088.
Sep. 15, 2020 Office Action issued in Japanese Patent Application No. 2017-540928.

* cited by examiner

GRINDER

CROSS-REFERENCE TO RELATED APPLICATION

The present international patent application claims the benefit of Japanese Patent Application No. 2015-188012, filed on Sep. 25, 2015, in the Japan Patent Office, the entire disclosure of which is incorporated herein by reference.

TECHNICAL FIELD

The present disclosure relates to a grinder providing a processed material with processing such as grinding, polishing, and cutting.

BACKGROUND ART

A grinder includes a spindle to be rotationally driven by a motor. The spindle protrudes from a housing in which the motor is housed and is provided at a tip end thereof with a circular-plate-shaped tip end tool. As a result, the tip end tool is rotated by rotation of the spindle to enable a processed material to be processed.

On an outer circumferential side of the spindle, a wheel cover partially covering the tip end tool is provided (see, for example, Patent Documents 1 and 2).

PRIOR ART DOCUMENTS

Patent Documents

Patent Document 1: Japanese Unexamined Patent Application Publication No. 2013-78823

Patent Document 2: Japanese Unexamined Patent Application Publication No. 2013-226617

SUMMARY OF THE INVENTION

Problems to be Solved by the Invention

A wheel cover is detachably attached around a protruding portion of a housing from which a spindle protrudes. For this reason, a user performs processing work of the processed material in a state in which the wheel cover is detached from the housing in some cases.

It is desirable in one aspect of the present disclosure to be able to provide a grinder that can be inhibited from being used in a state in which a wheel cover is not attached.

Means for Solving the Problems

A grinder according to one aspect of the present disclosure includes: a motor; a housing for housing the motor; and a spindle protruding from the housing and configured to be driven to be rotated by the motor in the housing.

To the housing, a wheel cover configured to cover a part of a tip end tool that is attached to the spindle is detachably attached, and a detector detects the wheel cover attached to the housing.

In response to non-detection of the wheel cover by the detector, a controller stops or restricts the spindle being driven by the motor.

Thus, with the grinder according to one aspect of the present disclosure, it is possible to inhibit the grinder from being used in a state in which the wheel cover is not attached to the housing (in other words, in a state in which a part of the tip end tool is not covered with the wheel cover).

The detector may be configured by a so-called non-contact detector that detects the wheel cover without contacting the wheel cover.

In a case in which the wheel cover is made of a magnetic body and includes an attaching portion to be attached to the housing, the detector may include a magnet and a Hall sensor arranged to be spaced apart from each other along an attaching part of the housing to which the attaching portion of the wheel cover is attached.

In the case in which the detector includes the magnet and the Hall sensor in this manner, magnetic flux from the magnet detected by the Hall sensor varies depending on the attaching state of the wheel cover to the housing. Accordingly, with use of the detector, whether or not the wheel cover is attached to the housing can be detected.

The detector may be configured as a so-called contact detector configured to contact the wheel cover directly or via an intermediate member to thereby detect the wheel cover.

In this case, the detector may include a switch configured to change on and off states in response to contacting the wheel cover directly or via the intermediate member.

Also, in a case in which the wheel cover includes an attaching portion to be attached to the housing, the detector may include a pressure sensor provided at an attaching part of the housing to which the wheel cover is attached via the attaching portion.

That is, in a case in which the wheel cover is attached to the attaching part of the housing, pressure is applied to the attaching part from the attaching portion of the wheel cover. Thus, the pressure sensor serving as the detector detects the pressure to detect the wheel cover.

In a case in which the attaching part of the housing is an outer circumference of a protruding part of the spindle formed to surround the spindle, the attaching portion of the wheel cover is formed in an annular shape that is fittable onto the attaching part of the housing.

In this case, a projection may be provided at a specified portion on an inner circumferential surface of the attaching portion of the annular shaped wheel cover, and the pressure sensor may be provided at the outer circumference of the attaching part of the housing in a continuous or distributed manner.

In this case, the pressure sensor serving as the detector can detect not only the fact that the wheel cover is attached but also a position of the projection provided on the inner circumferential surface of the attaching portion of the wheel cover.

Accordingly, the controller can recognize an attaching state of the wheel cover (for example, a position of the wheel cover around the spindle) based on the position of the projection detected by the detector and can control the spindle being driven by the motor. Consequently, in a case in which the detector is configured in this manner, it is possible to restrict the grinder from being used in a state in which the wheel cover is not attached to the housing.

Also, the plurality of detectors may be provided to be distributed at different positions of the housing regardless of whether the detector is in a non-contact type or in a contact type.

By doing so, since the plurality of detectors can detect the wheel cover, the controller can recognize a setting state of the wheel cover based on the position and the detection result of each of the detectors and can control the spindle being driven by the motor based on the result.

Accordingly, by providing the plurality of detectors in this manner, it is possible to restrict the grinder from being used in a state in which the wheel cover is not attached to the housing.

In contrast, in the grinder, the controller is normally provided in the housing. Conversely, the detector is provided outside the housing since the detector is configured to detect the wheel cover. For this reason, a detection result from the detector needs to be transmitted to the controller via a signal line or wirelessly.

In a case in which the detector and the controller are coupled via the signal line, it would be preferable to house the signal line in the housing. However, since various functional parts such as the motor are housed in the housing, it may be difficult to arrange the signal line in the housing.

Accordingly, at least a part of the signal line may be arranged outside the housing, and the signal line arranged outside the housing may be covered with a protection cover.

Also, in a case in which the signal line is housed in the housing, the signal line may be arranged outside a stator of the motor and be housed in the housing together with the motor.

On the other hand, in a case in which a detection result provided by the detector is transmitted to the controller wirelessly, a transmitter may be provided for this purpose, and the controller may be configured to receive a signal wirelessly transmitted from the transmitter and determine whether or not the wheel cover is detected by the detector.

Also, in this case, to transmit the detection result provided by the detector wirelessly from the transmitter, the transmitter needs to be supplied with an electric power. To supply the electric power, a battery may be incorporated in the transmitter. Also, a power generator configured to generate an electric power due to rotation of the motor and the spindle or vibration of the grinder may be provided, and the transmitter may be configured to receive the electric power from the power generator to operate.

BRIEF DESCRIPTION OF THE DRAWINGS

FIG. 22A illustrates a state in which a signal line is arranged outside a housing, and FIG. 22B illustrates a state in which a protection cover covering the signal line is provided.

FIG. 23A illustrates a state before a folder 45 is attached to the stator 13, and FIG. 23B illustrates the stator 13 to which the folder 45 is attached.

FIG. 27A illustrates an external view of the power generator, and FIG. 27B illustrates an internal configuration of the power generator.

EXPLANATION OF REFERENCE NUMERALS

2 . . . grinder, 4 . . . motor housing, 6 . . . gear housing, 7 . . . brake device, 8 . . . rear cover, 10 . . . wheel cover, 12 . . . motor, 13 . . . stator, 20 . . . first bevel gear, 22 . . . second bevel gear, 24 . . . spindle, 30 . . . internal housing, 31 . . . attaching part, 36 . . . tip end tool, 37 . . . attaching portion, 37A . . . projection, 38 . . . tightening tool, 40 . . . metal sensor, 42, 42A . . . signal line, 43A, 43B . . . protection cover, 50 . . . circuit board, 44, 49, 52 . . . magnet,

45 . . . folder, 46 . . . transmitter, 48 . . . power generator, 54 . . . Hall sensor, 56 . . . pressure sensor, 58, 60 . . . micro switch, 62, 64 . . . intermediate member, 66 . . . switch, 70 . . . circular plate, 72 . . . sensor, 80 . . . external power supply, 82 . . . main switch, 84 . . . triac, 86 . . . driving circuit, 88 . . . zero cross detection circuit, 90 . . . control circuit, 92 . . . power supply circuit, 94 . . . switch detection circuit, 96 . . . cover detection circuit, 98 . . . receiver

MODE FOR CARRYING OUT THE INVENTION

Hereinbelow, embodiments of the present disclosure will be described with reference to the drawings.

First Embodiment

Figure 1:
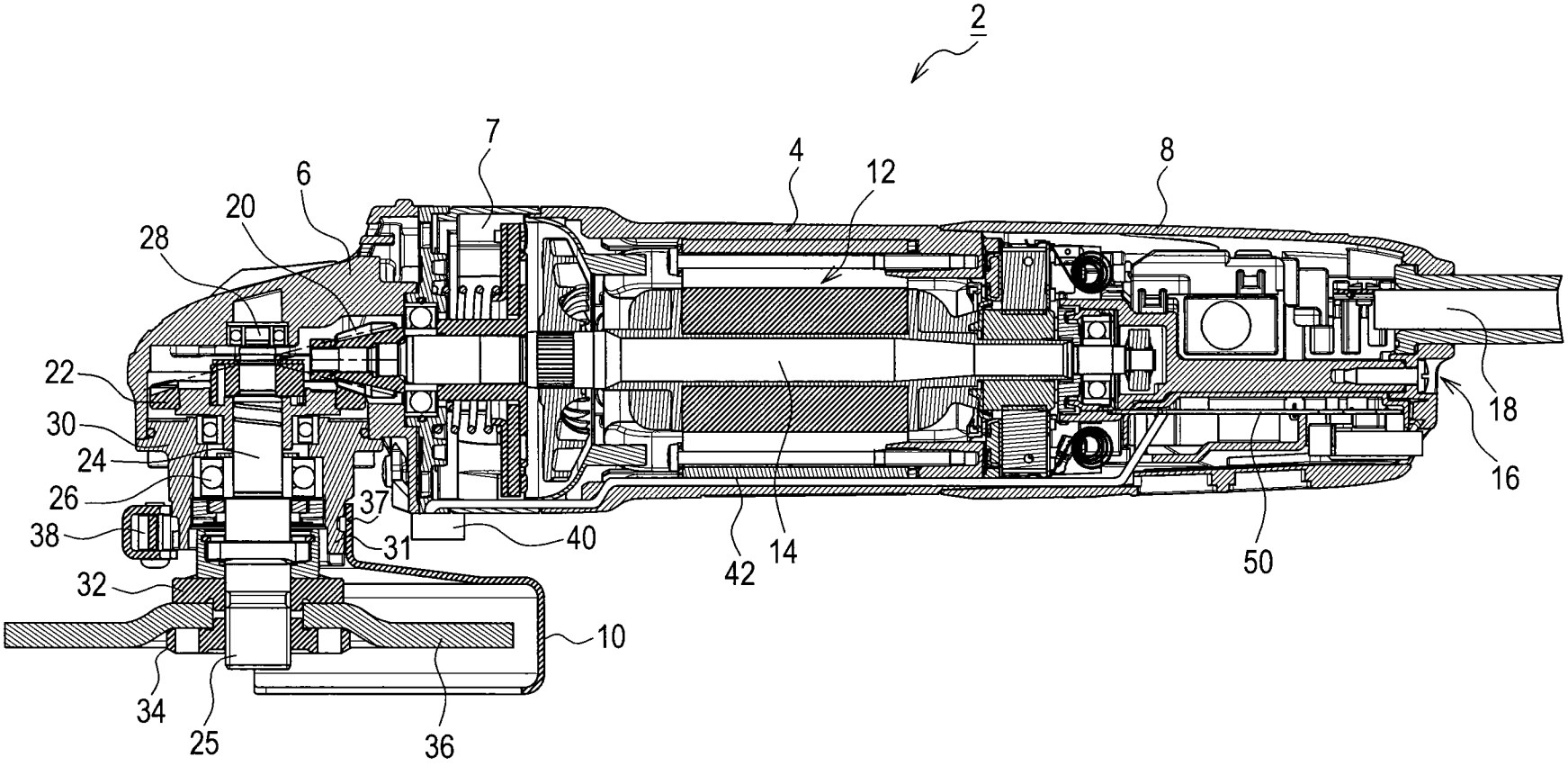
FIG. 1 is a cross-sectional view illustrating a configuration of a grinder according to a first embodiment.

As illustrated in FIG. 1, a grinder 2 according to the present embodiment mainly includes a motor housing 4, a gear housing 6, a rear cover 8, and a wheel cover 10.

The motor housing 4 is an a substantially cylindrical housing and houses a motor 12 therein. A rotation shaft 14 of the motor 12 is arranged to protrude toward the gear housing 6.

The rear cover 8 is provided on one end side in a direction along a center axis of the motor housing 4 and houses a power supply line portion 16 therein. The power supply line portion 16 is provided with a power supply cord 18 to supply current from an external power supply and a circuit board 50. The power supply line portion 16 is electrically coupled to the motor 12 and the circuit board 50.

The gear housing 6 is provided on an opposite side of the rear cover 8 of the motor housing 4 with a brake device 7 interposed therebetween and houses therein a first bevel gear 20, a second bevel gear 22, a spindle 24, bearings 26 and 28, and the like.

The brake device 7 is configured to move a brake member to thereby provide the rotation shaft 14 of the motor 12 with a braking force when a main switch 82 (sliding switch: see, FIG. 2) provided on an outside wall of the gear housing 6 is externally switched to an off-state. The brake device 7 is described in detail in Japanese Unexamined Patent Application Publication No. 2013-022702 and the like, and detailed description thereof is thus omitted here.

The first bevel gear 20 is secured to the rotation shaft 14 of the motor 12 in the gear housing 6. The second bevel gear 22, the spindle 24, and the bearings 26 and 28 are provided integrally with an internal housing 30 formed separately from the gear housing 6, and the internal housing 30 is fitted and secured inside the gear housing 6 such that the second bevel gear 22, the spindle 24, and the bearings 26 and 28 are housed in the gear housing 6.

In the internal housing 30, the spindle 24 is rotatably provided via the bearing 26. The internal housing 30 is cylindrical and coaxial with a center axis of the spindle 24 and is secured in the gear housing 6 so as to arrange the spindle 24 may be perpendicular to the rotation shaft 14 of the motor 12.

The second bevel gear 22 is secured to the spindle 24, engaged with the first bevel gear 20 in the gear housing 6, and converts a rotation output of the motor 12 into a rotation force of the spindle 24 around the axis.

One end of the spindle 24 is rotatably supported by the gear housing 6 via the bearing 28 while the other end of the spindle 24 protrudes outward from the internal housing 30 (that is, the gear housing 6).

The protruding part of the spindle 24 from the gear housing 6 is provided with an inner flange 32 configured to position and secure a circular-plate-shaped tip end tool 36. Also, an outer circumferential part of a part of the spindle 24 further on a tip end side than the inner flange 32 is provided with a screw portion 25 with which a lock nut 34 is to be screwed. The lock nut 34 is configured to clamp the tip end tool 36 between the lock nut 34 and the inner flange 32.

In the grinder 2 configured as mentioned above, when the main switch 82 turns into an on-state, the motor 12 is rotated, and the rotation output is transmitted via a gear mechanism (for example, the first bevel gear 20 and the second bevel gear 22) in the gear housing 6 into the spindle 24.

Thus, when the tip end tool 36 is secured to the spindle 24 via the lock nut 34, the tip end tool 36 is rotated to enable work such as grinding, polishing, and cutting to be performed. Examples of the tip end tool 36 used in the grinder 2 in this manner include a grinding stone, a cutting stone, and a wire brush.

The wheel cover 10 is configured to protect a user from scattering of fragments of the processed material and the tip end tool 36 generated in the work such as grinding, polishing, and cutting. For this reason, the wheel cover 10 is formed in a substantially semi-circular shape to cover a part (approximately a half in the present embodiment) of the tip end tool 36 secured to the spindle 24 from the side of the gear housing 6.

The wheel cover 10 is secured at a part of the internal housing 30 at which the spindle 24 protrudes.

That is, in the internal housing 30, an attaching part 31 to which the wheel cover 10 is to be attached is coaxial with the center axis of the spindle 24 and has a cylindrical shape to surround the spindle 24.

Also, in the wheel cover 10, a center part of a semi-circular plate arranged to be opposed to a plate of the tip end tool 36 and located further on a side of the internal housing 30 than the tip end tool 36 is provided with an attaching portion 37 to be secured at the outer circumference of the attaching part 31 of the internal housing 30.

The attaching portion 37 is in an annular shape to be fitted onto the attaching part 31 of the internal housing 30, and a part of the annular portion is opened to enable the attaching portion 37 to be tightened and secured around the attaching part 31 a tightening tool 38. Since the configuration of the attaching portion 37 is common in grinders, detailed description thereof is omitted.

In the grinder 2 configured as mentioned above, the wheel cover 10 can be detachably attached to the internal housing 30. Also, by loosening tightening of the internal housing 30 by the attaching portion 37, the wheel cover 10 can turn around the spindle 24, and a protection area of the tip end tool 36 which can be protected by the plate of the semi-circular wheel cover 10 can be changed.

The reason for enabling the protection area to be changed as mentioned above is that a area of the tip end tool 36 which is to be exposed as seen from the grinder 2 differs depending on the application (for example, grinding, polishing, or cutting) of the tip end tool 36. The user can change the position of the wheel cover 10 in accordance with the work detail.

Although the grinder 2 should be used in a state in which the wheel cover 10 is attached, the wheel cover 10 is detachable from the grinder 2 for replacement or the like. Thus, in some cases, the grinder 2 may be used in a state in which the wheel cover 10 is detached.

Under such circumstances, the grinder 2 according to the present embodiment is provided with a metal sensor 40 in order to detect the wheel cover 10 attached to the internal housing 30.

The metal sensor 40 is a non-contact detector and is provided at a position on an outside wall of the grinder 2 at which the metal sensor 40 can detect the wheel cover 10 even when the wheel cover 10 attached to the internal housing 30 turns around the spindle 24.

More specifically, the metal sensor 40 is arranged at a position further on a rear side than the internal housing 30 (specifically, on a side of the brake device 7) and opposed to the tip end tool 36 attached to the spindle 24.

The metal sensor 40 can detect the wheel cover 10 because the wheel cover 10 is made of a metal plate composed mainly of iron (that is, a magnetic body). For example, the metal sensor 40 detects the wheel cover 10 based on static capacitance generated between the metal sensor 40 and the wheel cover 10. On the other hand, the main body side of the grinder 2 including the motor housing 4, the gear housing 6, the internal housing 30, and the like is made of a metal material composed mainly of aluminum (that is, a non-magnetic body).

The metal sensor 40 is coupled to the circuit board 50 provided in the rear cover 8 via a signal line 42 arranged inside the grinder 2 and running along the brake device 7 and the motor housing 4 to reach the rear cover 8.

Figure 2:
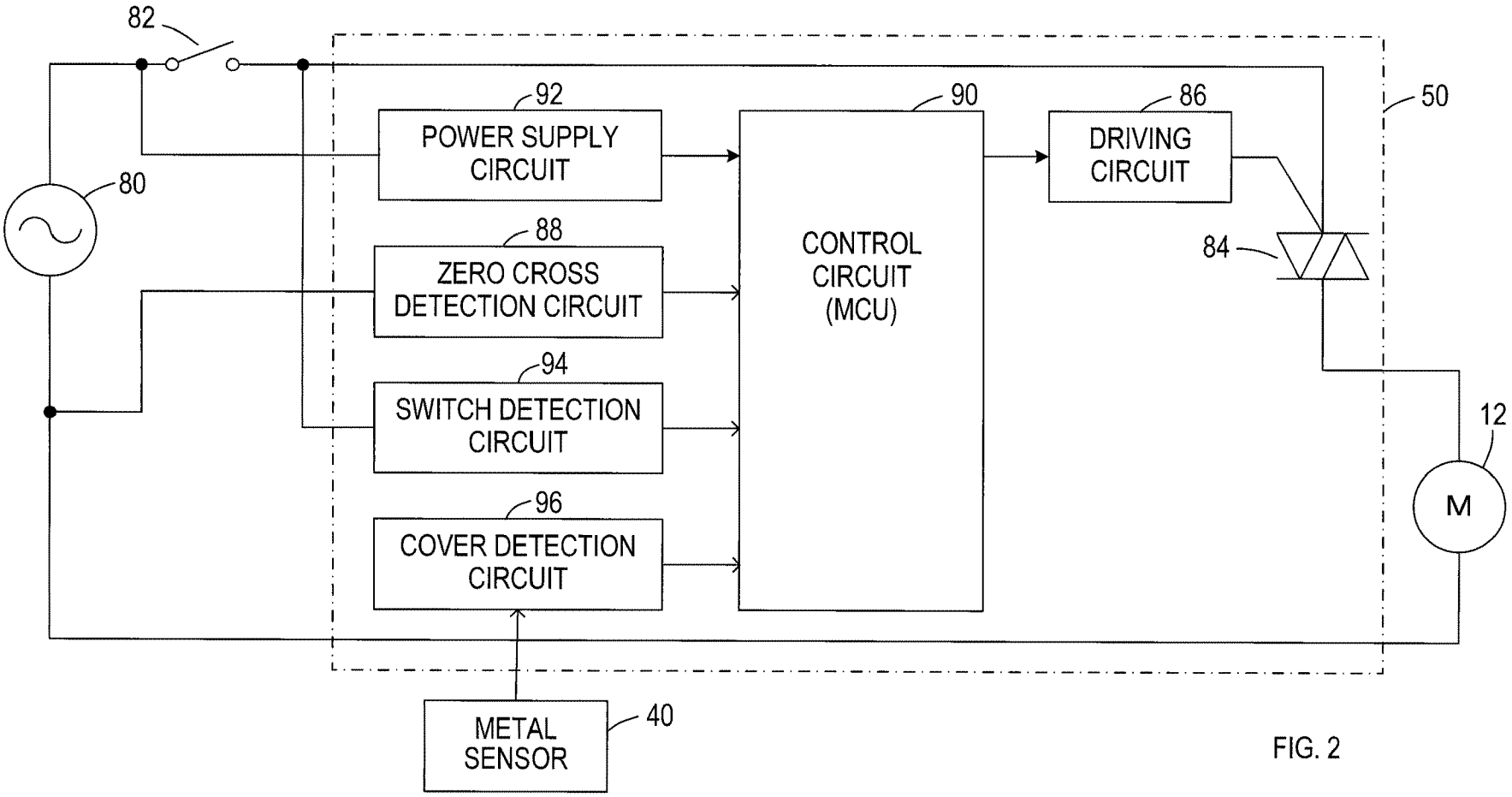
FIG. 2 is a block diagram illustrating a configuration of an entire control system of the grinder.

The circuit board 50 is configured to drive and control the motor 12 with an alternating voltage supplied from an external power supply 80 via the power supply cord 18 when the main switch 82 is in an on-state, and a circuit illustrated in FIG. 2 is implemented on the circuit board 50.

As illustrated in FIG. 2, on a power supply path from the external power supply 80 (in general, a commercial power supply) to the motor 12, the main switch 82 and a triac 84 are coupled to each other in series. The triac 84 is implemented on the circuit board 50.

The circuit board 50 is provided with a driving circuit 86 configured to drive the motor 12 via the triac 84, a zero cross detection circuit 88 configured to detect a zero cross point of the alternating voltage, and a control circuit 90 serving as a controller.

The control circuit 90 is configured to turn on and off the triac 84 via the driving circuit 86 based on a detection signal from the zero cross detection circuit 88 to control an electric power to be supplied to the motor 12 and is a microcontroller (MCU).

The circuit board 50 also includes a power supply circuit 92 configured to rectify the alternating voltage supplied from the external power supply 80 and generate direct voltage for driving of internal circuits, a switch detection circuit 94 configured to detect on and off states of the main switch 82, and a cover detection circuit 96.

The cover detection circuit 96 is a circuit configured to detect (determine) that the wheel cover 10 is attached to the internal housing 30 based on a detection signal from the metal sensor 40.

Detection signals from the cover detection circuit 96 and the switch detection circuit 94 are input into the control circuit 90, and the control circuit 90 controls driving of the motor 12 based on these detection signals.

Figure 3:
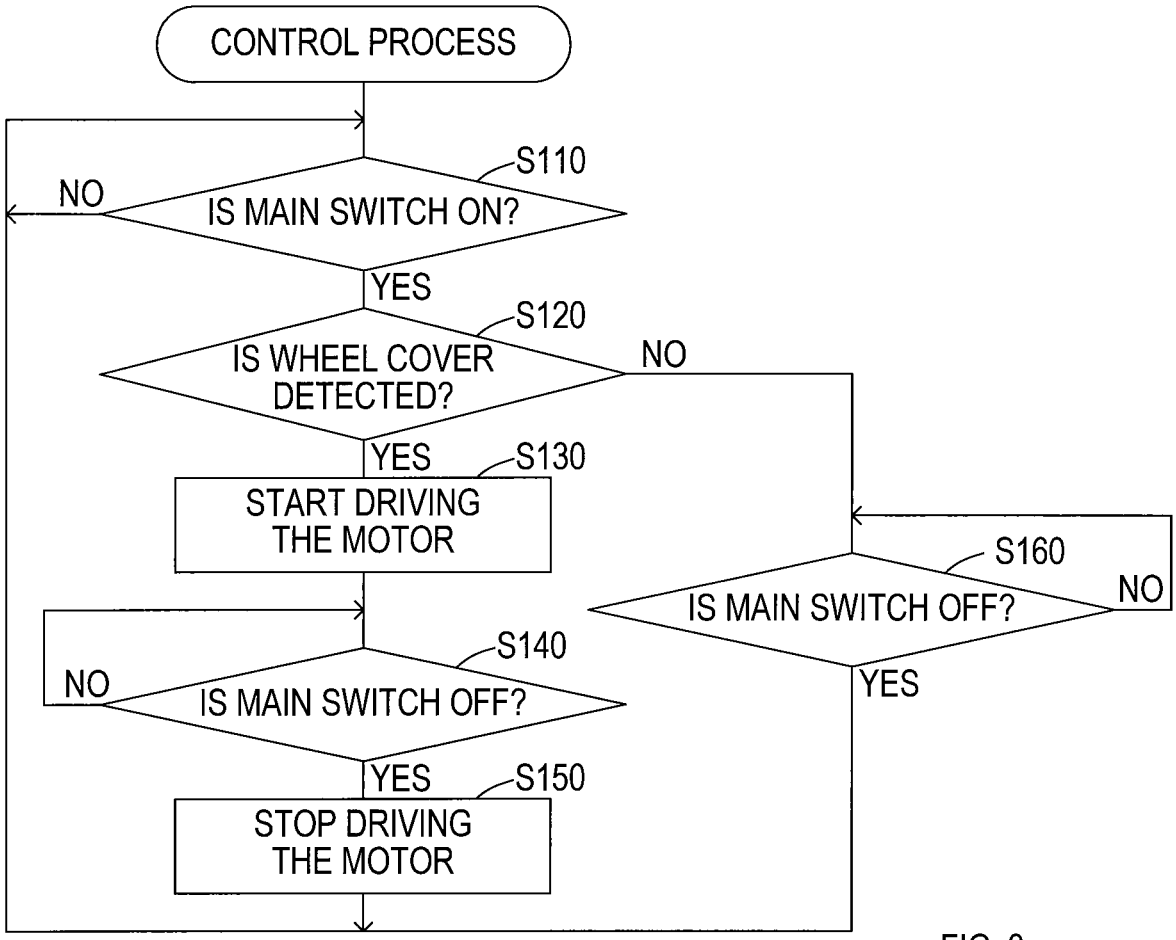
FIG. 3 is a flowchart illustrating a control process executed in a control circuit.

The control circuit 90 performs driving control of the motor 12 in a procedure illustrated in FIG. 3.

That is, in S110, the control circuit 90 determines whether or not the main switch 82 is in an on-state and waits until the user switches the main switch 82 from an off-state to an on-state.

Subsequently, when it is determined in S110 that the main switch 82 is in an on-state, the procedure moves to S120, and it is determined in the cover detection circuit 96 whether or not the wheel cover 10 is detected. In a case in which the wheel cover 10 is detected, the procedure moves to S130, and driving of the motor 12 is started.

After driving of the motor 12 is started in S130, it is determined in S140 whether or not the main switch 82 is in an off-state, and the control circuit 90 waits until the user switches the main switch 82 from an on-state to an off-state.

When it is determined in S140 that the main switch 82 is in an off-state, the procedure moves to S150 to stop driving of the motor 12 and moves to S110.

In a case in which it is determined in S120 that the wheel cover 10 is not detected, the procedure moves to S160 to determine whether or not the main switch 82 is in an off-state, and the control circuit 90 waits until the user switches the main switch 82 from an on-state to an off-state. When it is determined in S160 that the main switch 82 is in an off-state, the procedure moves to S110.

As mentioned above, the grinder 2 according to the present embodiment is provided with the metal sensor 40 serving as the detector configured to detect the wheel cover 10 attached to the internal housing 30. The cover detection circuit 96 uses the metal sensor 40 to determine whether or not the wheel cover 10 is attached to the internal housing 30.

When the main switch 82 is turned on, the control circuit 90 complies with the determination result of the cover detection circuit 96 and starts driving of the motor 12 only when the wheel cover 10 is attached to the internal housing 30.

Accordingly, in the grinder 2 according to the present embodiment, when the wheel cover 10 is not attached to the internal housing 30, the motor 12 is in a stop state, and the spindle 24 (and the tip end tool 36) is not rotated even when the main switch 82 is turned on.

Thus, according to the present embodiment, it is possible to inhibit the grinder to be used in a state in which the wheel cover 10 is not arranged on the outer circumferential side of the spindle 24 (that is, around the tip end tool 36).

The present embodiment is described so that the metal sensor 40 is used as a non-contact detector configured to detect the wheel cover 10. However, instead of the metal sensor 40, a distance measurement sensor configured to measure a distance to an object, a magnetic sensor configured to detect a magnet, or the like may be used.

The distance measurement sensor emits an ultrasonic wave and receives a reflected wave thereof to measure a distance to an object based on time spent during the emission and the reception. Thus, by arranging the distance measurement sensor at the same position as the metal sensor 40 and adjusting a direction in which the ultrasonic wave emits and a measurable distance, a distance between the distance measurement sensor and the semi-circular plate of the wheel cover 10 secured to the internal housing 30 can be measured. Also, the distance measurement sensor can also measure a distance to the attaching portion 37 of the wheel cover 10 fitted onto the attaching part 31 of the internal housing 30. In this case, the cover detection circuit 96 may determine that the wheel cover 10 is attached to the internal housing 30 in a case in which the measured distance is within a set range.

Also, in a case in which the magnetic sensor is used as the non-contact detector, a strip-shaped magnet may be wound around the outer circumference of the attaching portion 37 of the wheel cover 10 and may be detected by the magnetic sensor arranged at the same position as the metal sensor 40, for example. In this case, the cover detection circuit 96 may determine that the wheel cover 10 is attached to the internal housing 30 in a case in which the magnet is detected by the magnetic sensor.

First Modification Example

On the other hand, in a case in which the non-contact detector is used as in the present embodiment, not the wheel cover 10 itself but rotation of the tip end tool 36 attached to the spindle 24 may be detected.

Figure 4:
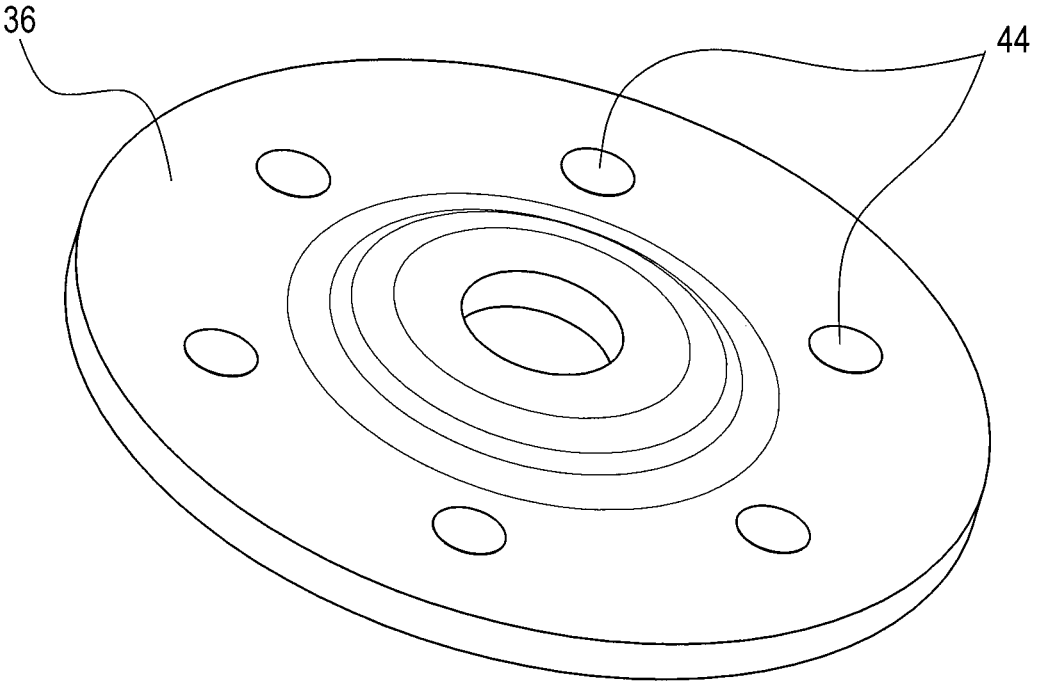
FIG. 4 is a perspective view illustrating a state of a tip end tool attached to a grinder according to a first modification example as seen from a side of the grinder.

For example, as illustrated in FIG. 4, a plurality of magnets 44 are provided on the plate of the tip end tool 36 on the side of the grinder 2 approximately at regular intervals in the circumferential direction and are detected by the magnetic sensor arranged at the same position as the metal sensor 40.

In this case, by rotating by the motor 12 the spindle 24 to which the tip end tool 36 is attached, the magnetic sensor can be operated as a rotation sensor. The cover detection circuit 96 may determine whether or not a rotation signal is input from the magnetic sensor. In a case in which no rotation signal is input, the cover detection circuit 96 may determine that the wheel cover 10 serving as a shield exists between the magnetic sensor and the tip end tool 36.

Figure 5:
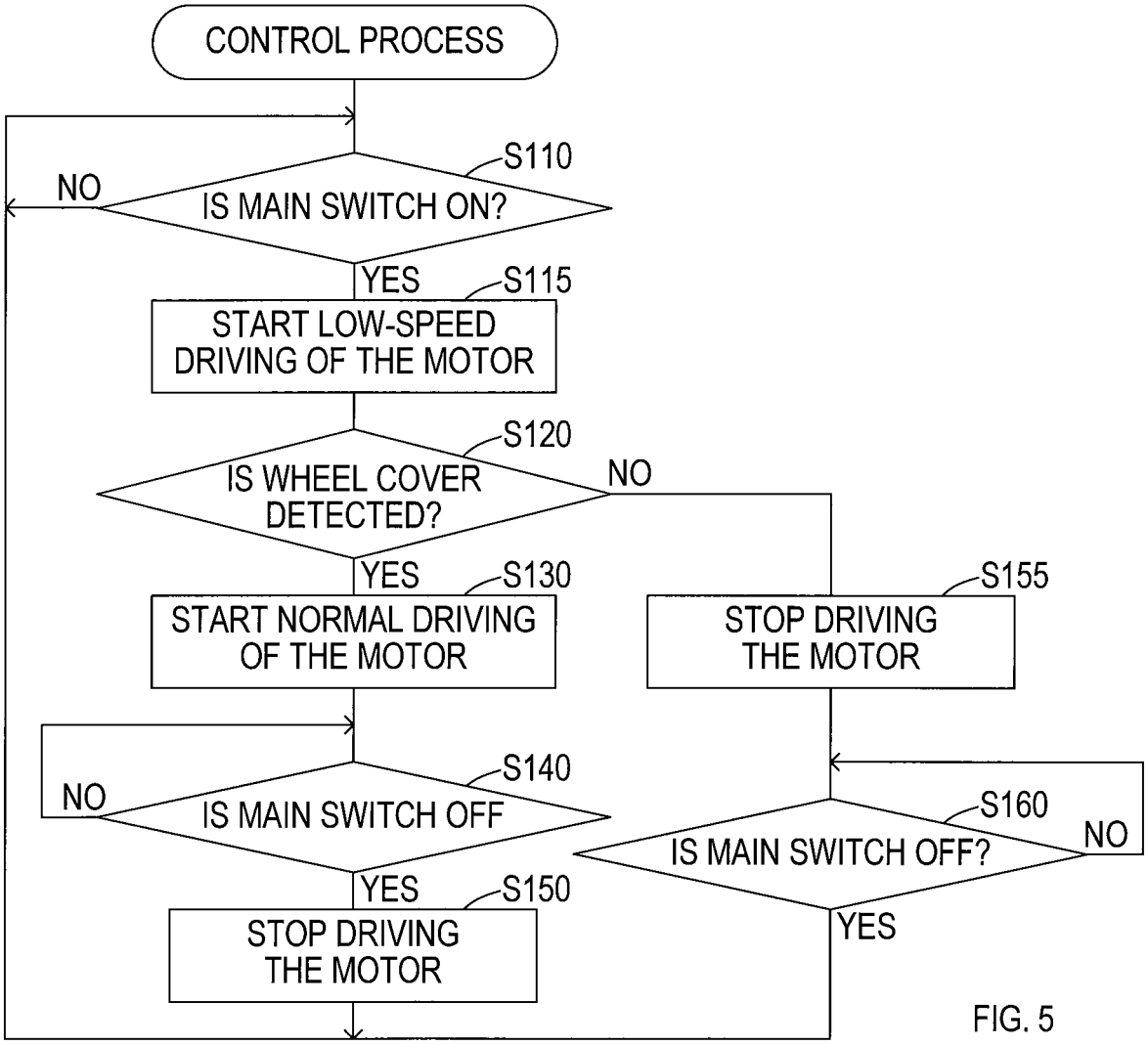
FIG. 5 is a flowchart illustrating a control process executed in a control circuit according to the first modification example.

Also, in a control process of the control circuit 90, as illustrated in FIG. 5, when it is determined in S110 that the main switch 82 is in an on-state, the procedure may move to S115 to start low-speed driving of the motor 12.

In the low-speed driving, the motor 12 is controlled to be driven so as to rotate at a rotation speed much lower than the rotation speed of the grinder 2 in a normal operation and equal to a rotation speed in which the tip end tool 36 is close to stop.

In this manner, the cover detection circuit 96 can determine whether or not the wheel cover 10 is attached as in the above case. Accordingly, in the control process, S120 and the subsequent steps may be executed in a similar manner to that illustrated in FIG. 3.

However, in a case in which it is determined in S120 that the wheel cover 12 is not attached, driving of the motor 12 needs to be stopped in S155 before moving to S160.

In the present modification example, the magnetic sensor is described to be arranged at the same position as the metal sensor 40 illustrated in FIG. 1. However, it is to be understood that the position of the magnetic sensor can arbitrarily be changed as long as the position enables the magnetic sensor to detect positions (rotation) of the magnets 44 provided on the tip end tool 36.

Also, in a case in which another detector such as a distance measurement sensor configured to measure a distance to an object and a magnetic sensor configured to detect a magnet provided on the wheel cover 10 is used instead of the metal sensor 40, the position where the detector is provided can arbitrarily be changed as long as the position enables the detector to detect the wheel cover 10.

Second Embodiment

Figure 6:
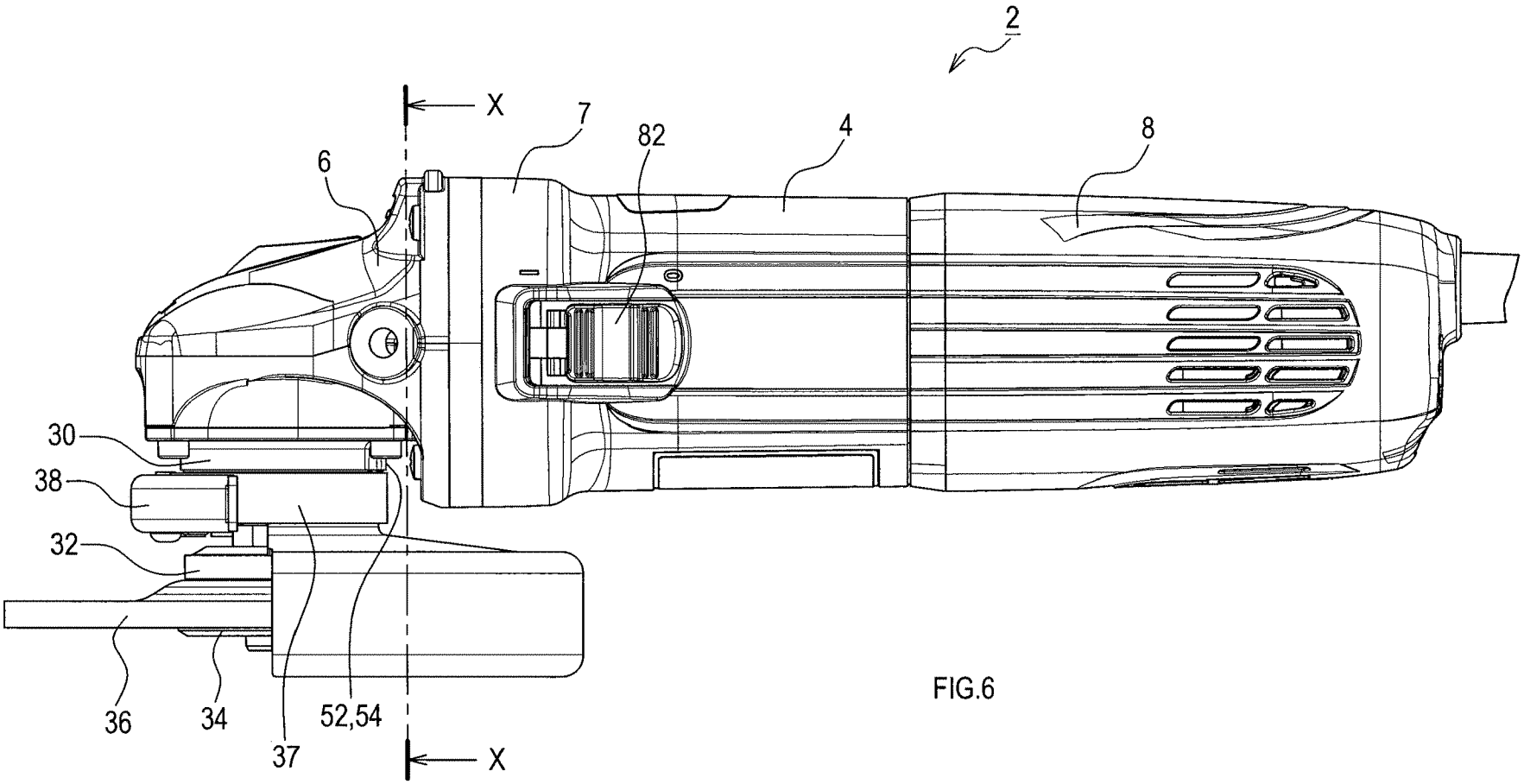
FIG. 6 is a side view illustrating a configuration of a grinder according to a second embodiment.
Figure 7:
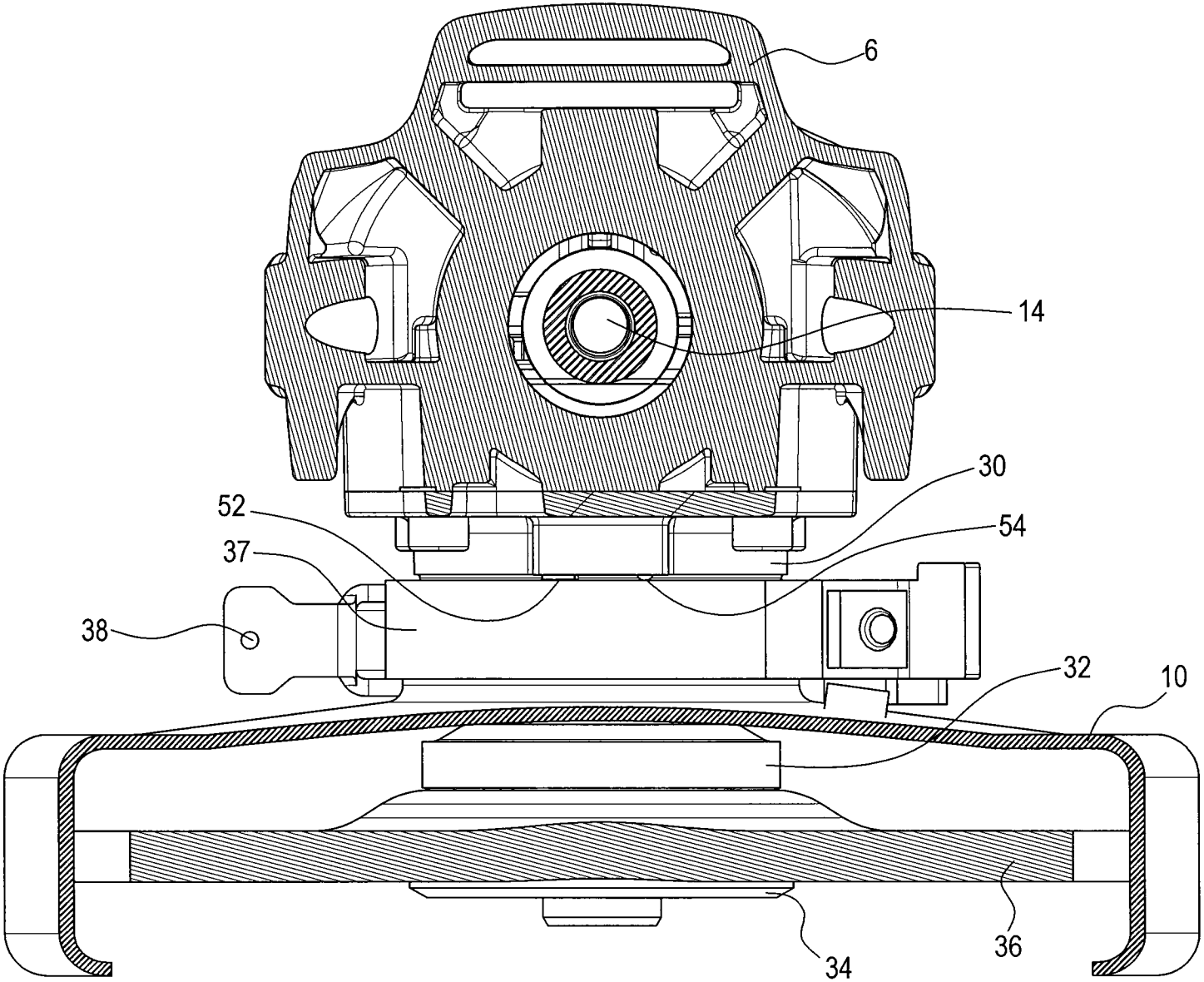
FIG. 7 is a cross-sectional view of the grinder illustrated in FIG. 6 along the line X-X.
Figure 8:
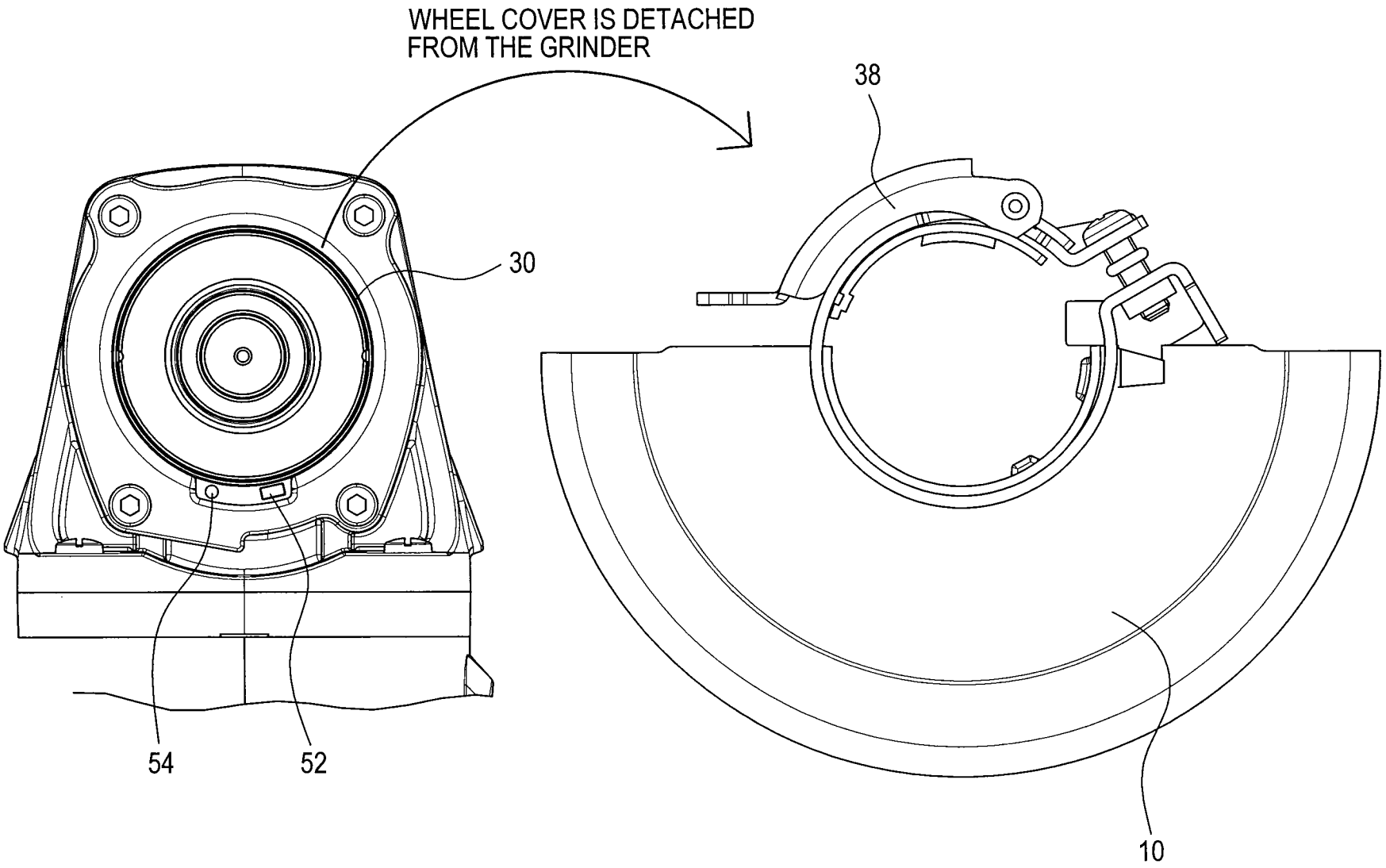
FIG. 8 is an explanatory diagram illustrating a state in which a wheel cover is detached from the grinder illustrated in FIG. 6.

The grinder 2 according to the present embodiment has a similar basic configuration to that of the grinder 2 according to the first embodiment and differs from the grinder 2 according to the first embodiment in that the detector configured to detect the wheel cover 10 includes a magnet 52 and a Hall sensor 54 as illustrated in FIGS. 6, 7, and 8. This respect will be described below. In FIGS. 6 to 8, similar components to those in the first embodiment are shown with the same reference numerals as mentioned above, and description of the duplicate components is omitted.

As illustrated in FIGS. 6 to 8, the magnet 52 and the Hall sensor 54 are arranged at positions at which, when the attaching portion 37 of the wheel cover 10 is attached to the attaching part 31 of the internal housing 30, magnetic flux ranging from the magnet 52 to the Hall sensor 54 changes.

That is, the magnet 52 and the Hall sensor 54 are arranged in the internal housing 30 further on a side of the gear housing 6 than the attaching part 31 to which the attaching portion 37 of the wheel cover 10 is attached so as to be spaced apart from each other along the outer circumferential edge of the attaching portion 37 of the wheel cover 10.

Thus, depending on whether or not the wheel cover 10 is attached to the internal housing 30, an output from the Hall sensor 54 changes. Accordingly, the cover detection circuit 96 can determine based on the output from the Hall sensor 54 whether or not the wheel cover 10 is attached to the internal housing 30.

Third Embodiment

Figure 9:
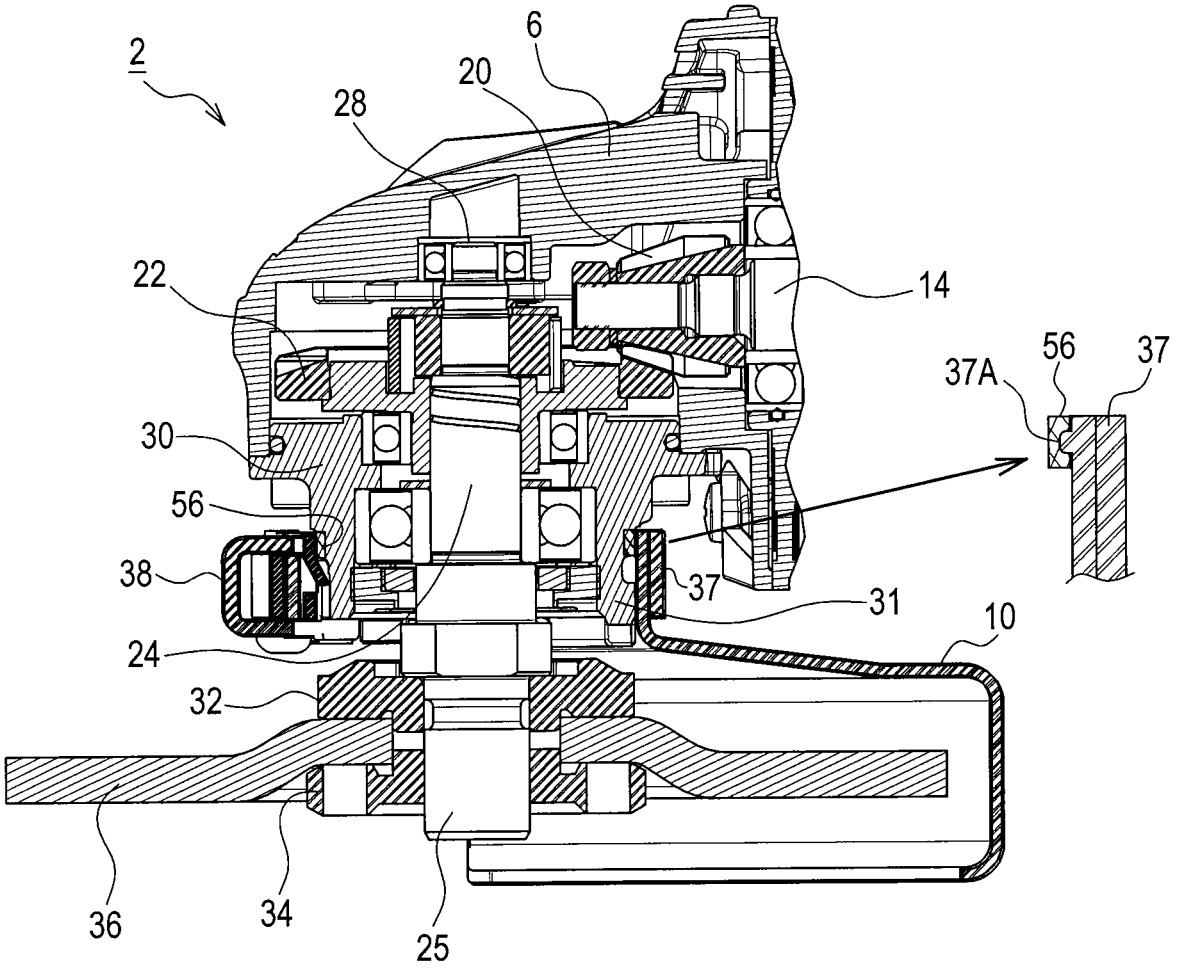
FIG. 9 is a cross-sectional view illustrating a configuration of a spindle and a periphery thereof of a grinder according to a third embodiment.
Figure 10:
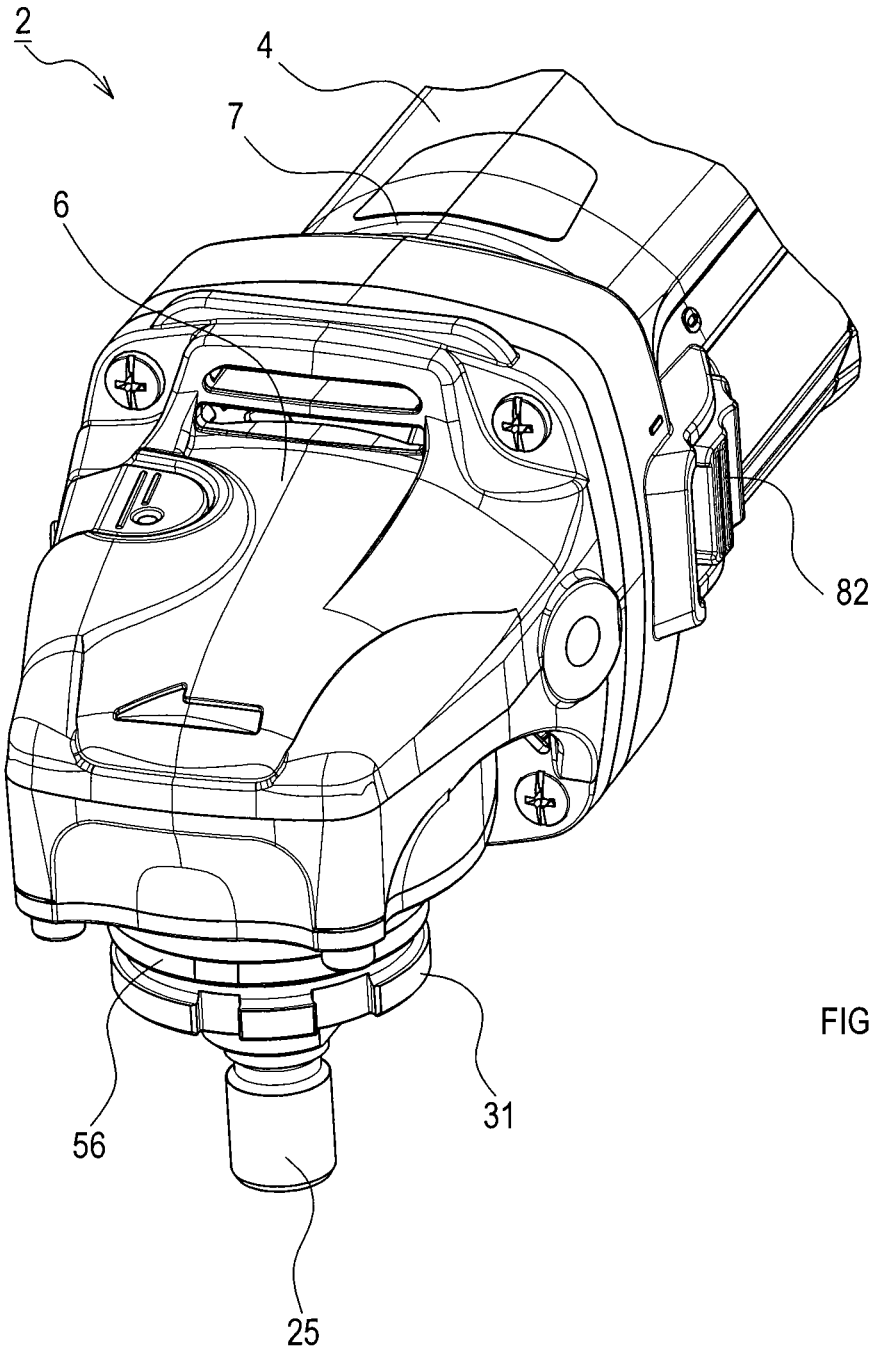
FIG. 10 is a perspective view illustrating an external view of the grinder illustrated in FIG. 9 around a gear housing.

The grinder 2 according to the present embodiment also has a similar basic configuration to that of the grinder 2 according to the first embodiment and differs from the grinder 2 according to the first embodiment in that the detector configured to detect the wheel cover 10 include a strip-shaped pressure sensor 56 as illustrated in FIGS. 9 and 10. This respect will be described below. In FIGS. 9 and 10, similar components to those in the first embodiment are shown with the same reference numerals as mentioned above, and description of the duplicate components is omitted.

The pressure sensor 56 according to the present embodiment is a strip-shaped pressure sensor configured to change a resistance value in accordance with pressure and is a so-called FSR (force sensing resistor: Registered Trademark).

The pressure sensor 56 is attached to the outside wall of the attaching part 31 of the internal housing 30 to which the attaching portion 37 of the wheel cover is attached.

Thus, depending on whether or not the wheel cover 10 is attached to the internal housing 30, a resistance value of the pressure sensor 56 changes. Accordingly, the cover detection circuit 96 can determine based on the output from the pressure sensor 56 whether or not the wheel cover 10 is attached to the internal housing 30.

Also, the pressure sensor 56 changes a resistance value in accordance with a pressing position.

Thus, as illustrated in the enlarged view in FIG. 9, by providing a projection 37A at an arbitrary position on the inside wall surface of the attaching portion 37 of the wheel cover 10, the control circuit 90 can detect an arranging position of the wheel cover 10 around the spindle 24 based on the resistance value of the pressure sensor 56.

In this case, the control circuit 90 can recognize work detail (grinding, polishing, cutting, or the like) of the grinder 2 based on the detected arranging position and can control rotation speed of the motor 12 (and the tip end tool 36) in accordance with the work detail.

A control process in such a case in which rotation speed of the motor 12 is controlled in accordance with the arranging position of the wheel cover 10 will be described below (see, FIG. 20).

Also, as the pressure sensor 56, a strain gauge, a piezoelectric element, or the like may be used. Also, the plurality of pressure sensors 56 may be provided to be distributed at the outer circumference of the attaching part 31 of the internal housing 30.

Fourth Embodiment

Figure 11:
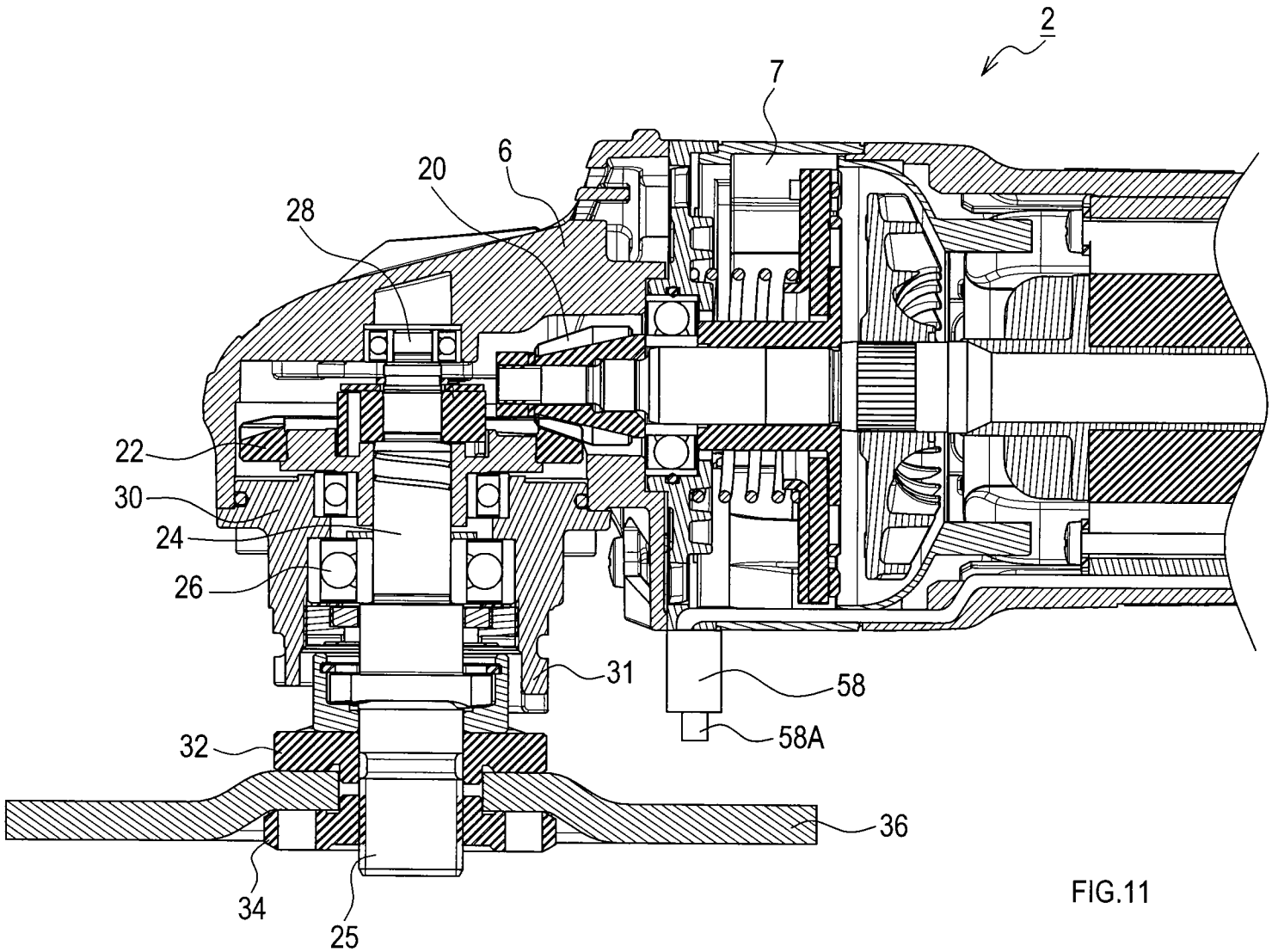
FIG. 11 is a cross-sectional view illustrating a configuration of a spindle and a periphery thereof of a grinder according to a fourth embodiment.
Figure 12:
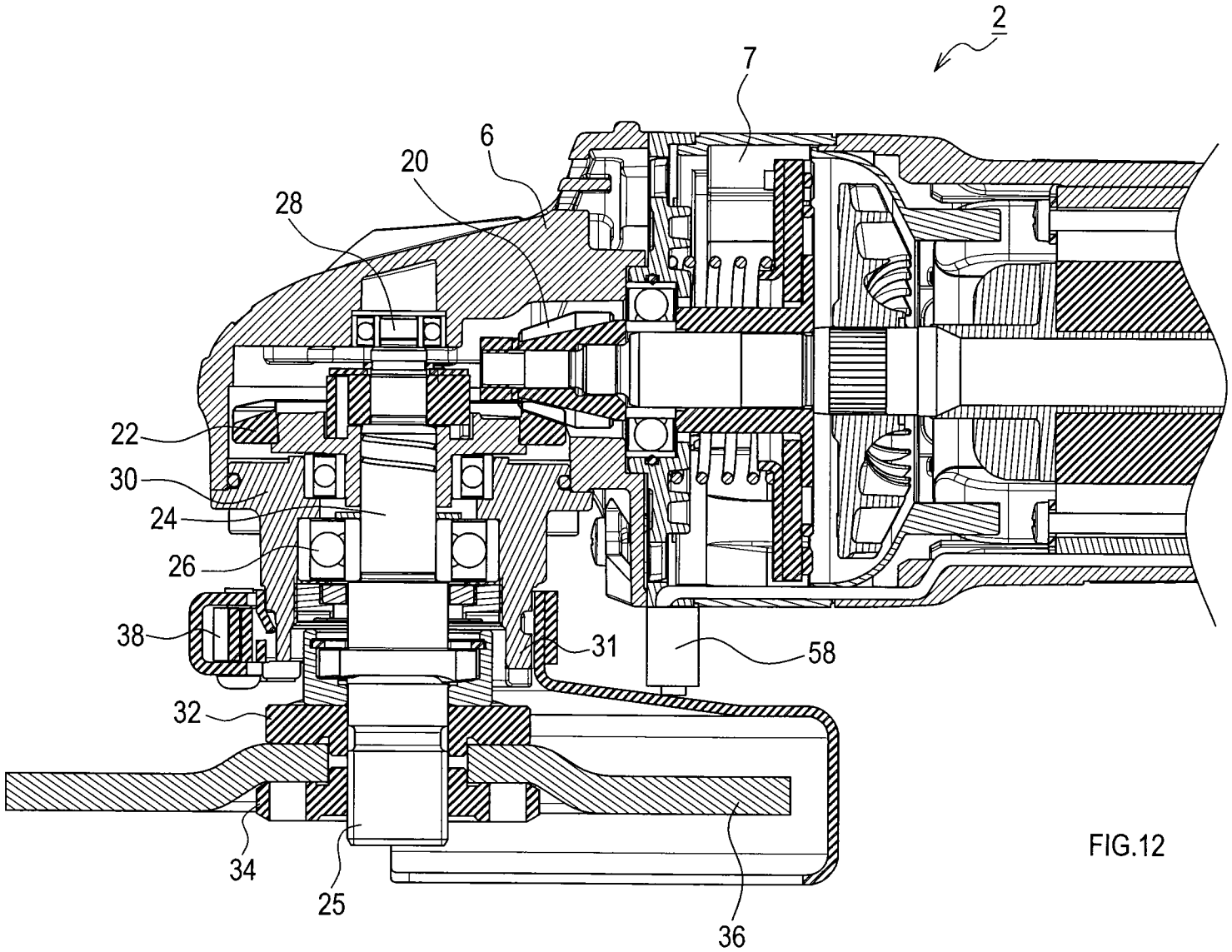
FIG. 12 is a cross-sectional view illustrating a state in which a wheel cover is attached to the grinder illustrated in FIG. 11.

The grinder 2 according to the present embodiment also has a similar basic configuration to that of the grinder 2 according to the first embodiment and differs from the grinder 2 according to the first embodiment in that the detector configured to detect the wheel cover 10 includes a micro switch 58 as illustrated in FIGS. 11 and 12. This respect will be described below. In FIGS. 11 and 12, similar components to those in the first embodiment are shown with the same reference numerals as mentioned above, and description of the duplicate components is omitted.

The micro switch 58 is a contact detector and is provided at a similar position to that of the metal sensor 40 in FIG. 1 so that, a terminal portion 58A contacts the semi-circular plate of the wheel cover 10 and the micro switch 58 turns into an on-state when the wheel cover 10 is attached to the internal housing 30.

Thus, the cover detection circuit 96 can determine based on the on-state and off-state of the micro switch 58 whether or not the wheel cover 10 is attached to the internal housing 30.

Second Modification Example

Figure 13:
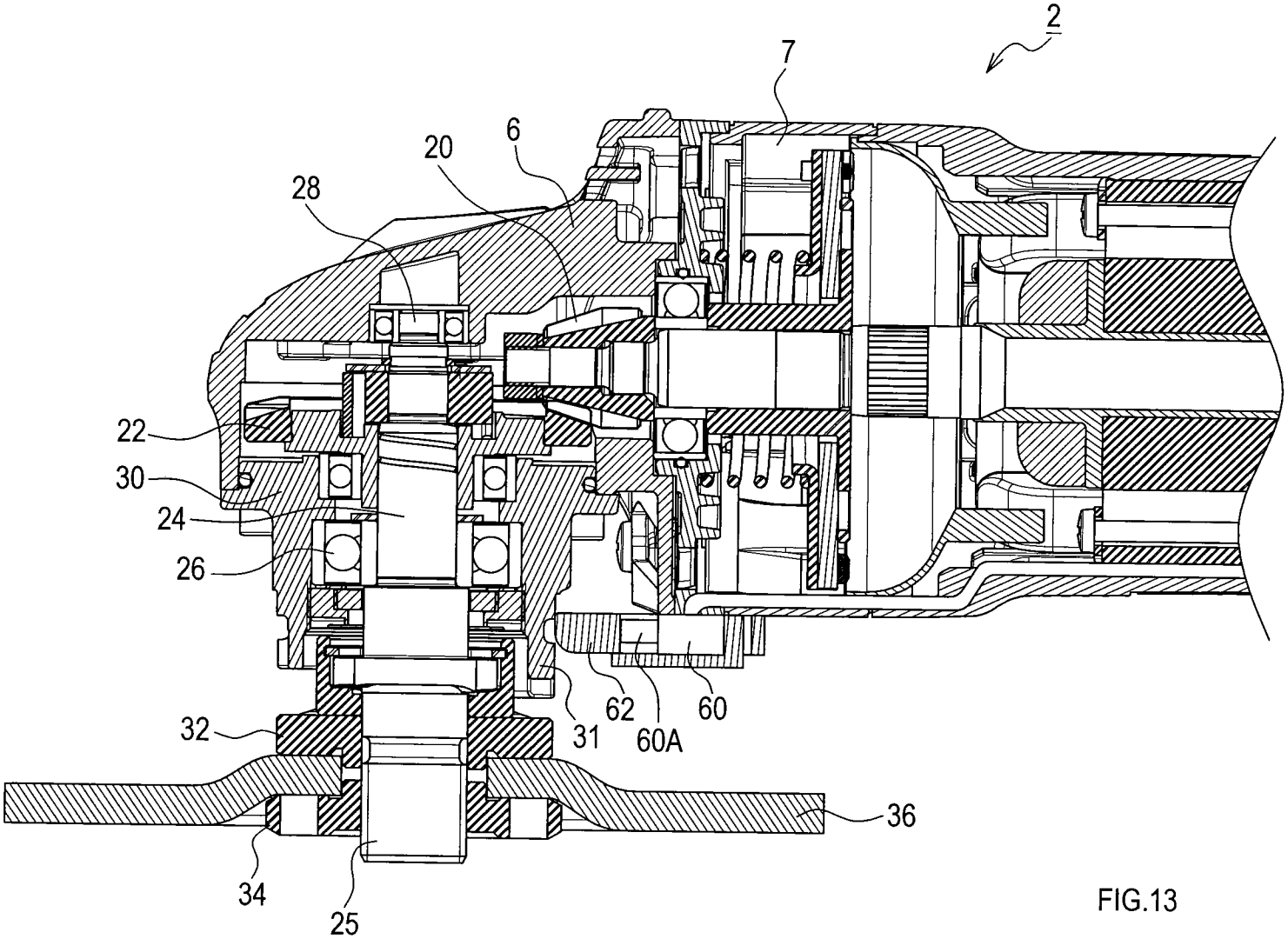
FIG. 13 is a cross-sectional view illustrating a configuration of a spindle and a periphery thereof of a grinder according to a second modification example.
Figure 14:
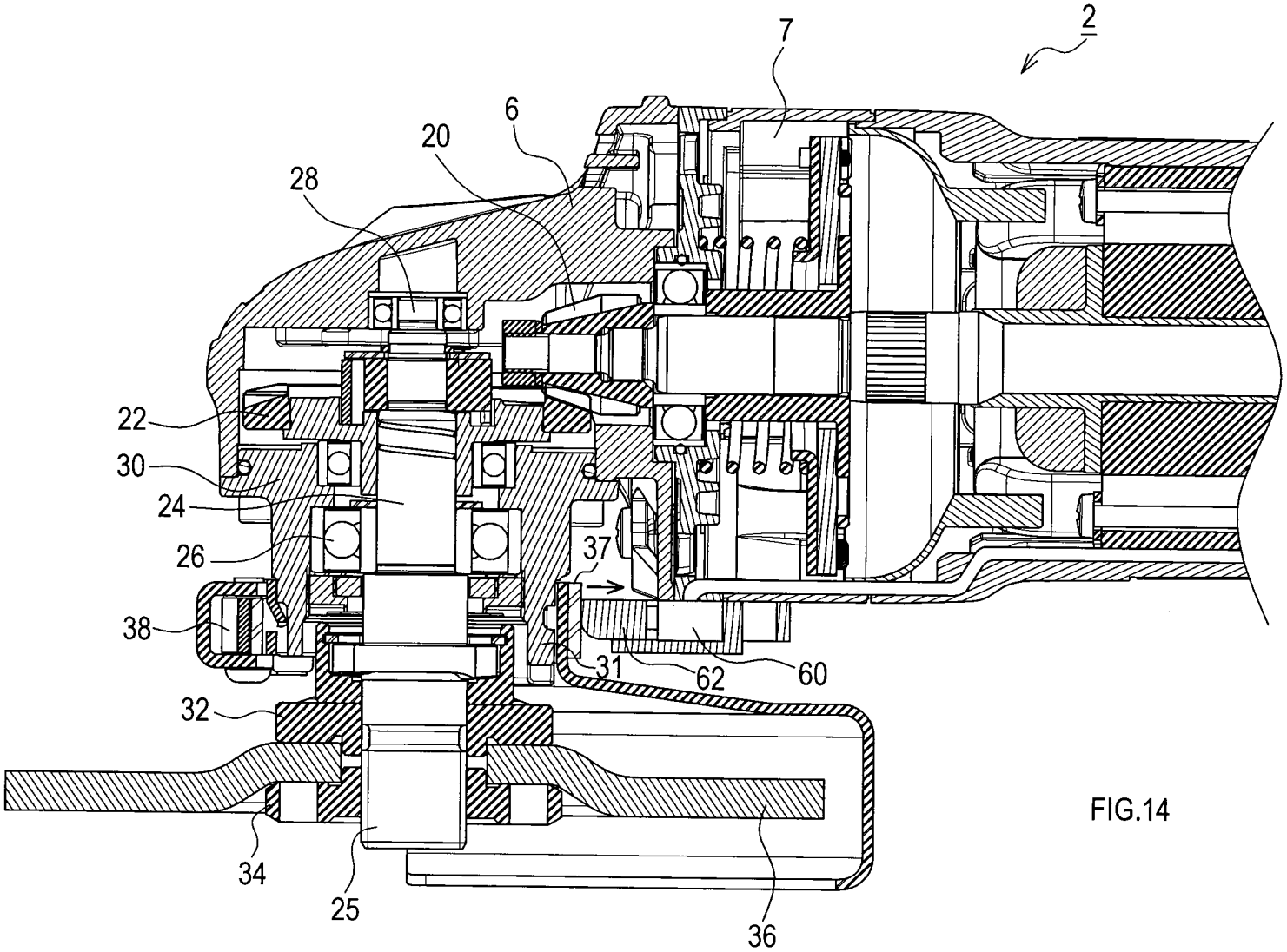
FIG. 14 is a cross-sectional view illustrating a state in which a wheel cover is attached to the grinder illustrated in FIG. 13.

In a case in which a micro switch is used as the detector as described in the present embodiment, a micro switch 60 may be arranged so that a terminal portion 60A faces the attaching part 31 of the internal housing 30 as illustrated in FIGS. 13 and 14.

In this case, an intermediate member 62 may be provided between the terminal portion 60A and the attaching part 31 of the internal housing 30 so that, the terminal portion 60A of the micro switch 60 is displaced by the attaching portion 37 of the wheel cover 10 when the wheel cover 10 is attached to the internal housing 30.

Third Modification Example

Figure 15:
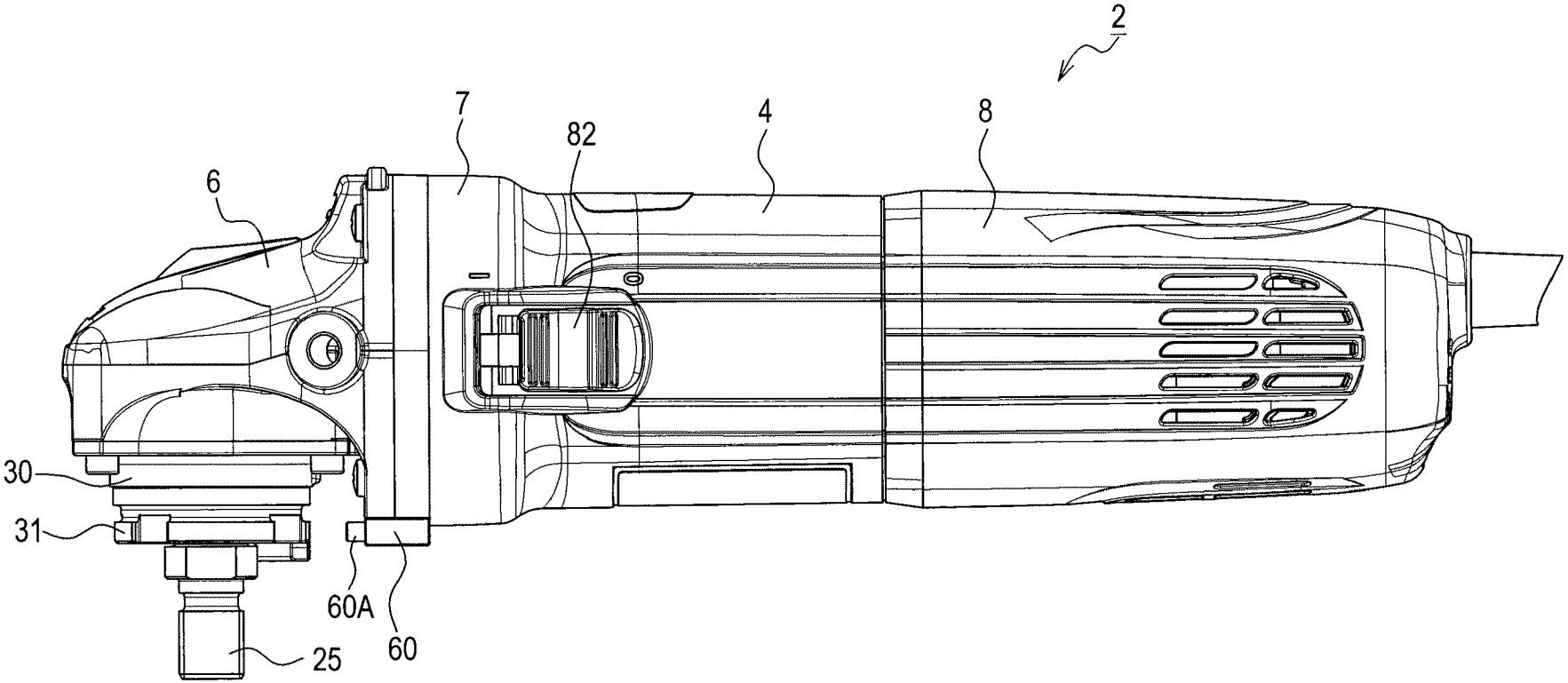
FIG. 15 is a side view illustrating a configuration of a grinder according to a third modification example.

Also, such an intermediate member configured to displace the terminal portion 60A of the micro switch 60 when the wheel cover 10 is attached to the internal housing 30 is not necessarily provided to a side of the micro switch 60 as illustrated in FIG. 15.

Figure 16:
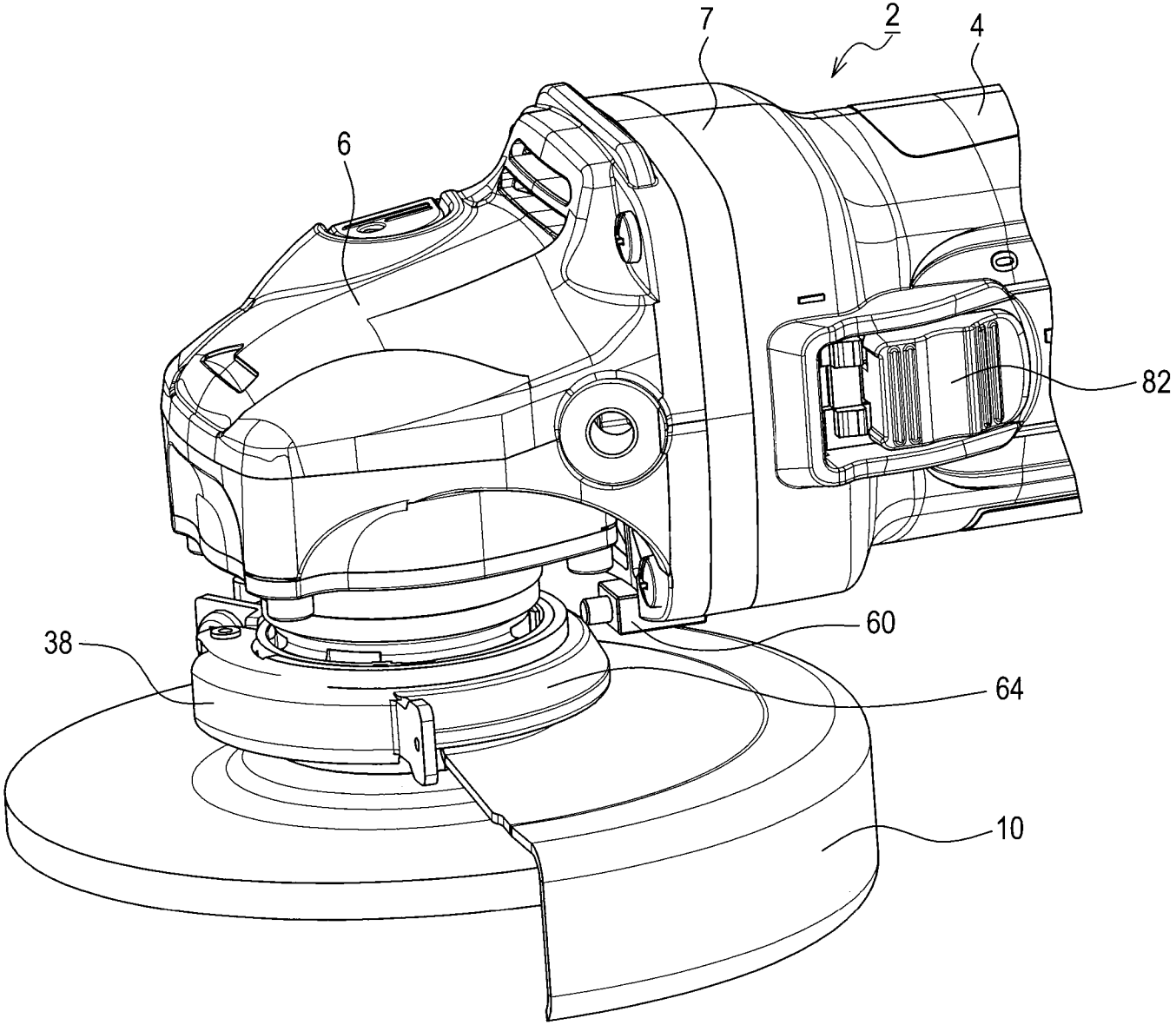
FIG. 16 is a perspective view illustrating a state in which a wheel cover is attached to the grinder illustrated in FIG. 15.

That is, as illustrated in FIG. 16, an intermediate member 64 configured to contact the terminal portion 60A of the micro switch 60 and turn on the micro switch 60 when the wheel cover 10 is attached to the internal housing 30 may be provided around the attaching portion of the wheel cover 10.

Fifth Embodiment

Figure 17:
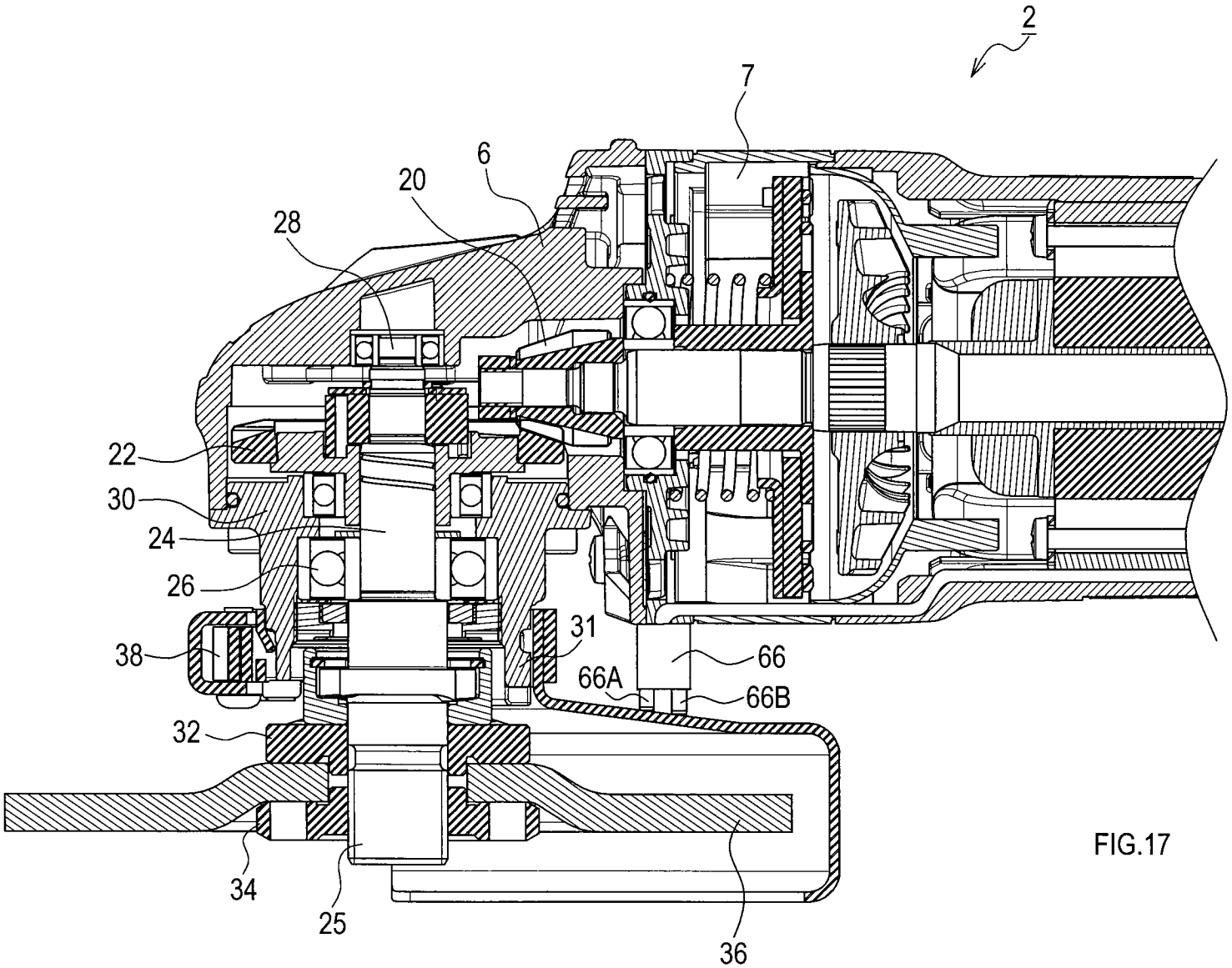
FIG. 17 is a cross-sectional view illustrating a configuration of a spindle and a periphery thereof of a grinder according to a fifth embodiment.

The grinder 2 according to the present embodiment has a similar basic configuration to that of the grinder 2 according to the first embodiment and differs from the grinder 2 according to the first embodiment in that the detector configured to detect the wheel cover 10 includes a switch 66 from which a pair of terminals 66A and 66B protrudes as illustrated in FIG. 17. This respect will be described below. In FIG. 17, similar components to those in the first embodiment are shown with the same reference numerals as mentioned above, and description of the duplicate components is omitted.

As illustrated in FIG. 17, the terminals 66A and 66B of the switch 66 protrude from the switch 66 toward the tip end tool 36 so that, the terminals 66A and 66B contact the semi-circular plate of the wheel cover 10 when the wheel cover 10 is attached to the internal housing 30.

On the other hand, as for the wheel cover 10, a conductive tape is attached, or conductive paint is applied, to a part of the wheel cover 10 opposed to the terminals 66A and 66B of the switch 66 when the wheel cover 10 is attached to the internal housing 30 (for example, an arcuate area centering on the spindle 24).

As a result, when the wheel cover 10 is attached to the internal housing 30, the terminals 66A and 66B of the switch 66 are electrically coupled to each other, and the switch 66 is turned into an on-state.

In this manner, the cover detection circuit 96 can determine based on the on-state and the off-state of the switch 66 whether or not the wheel cover 10 is attached to the internal housing 30.

Sixth Embodiment

Figure 18:
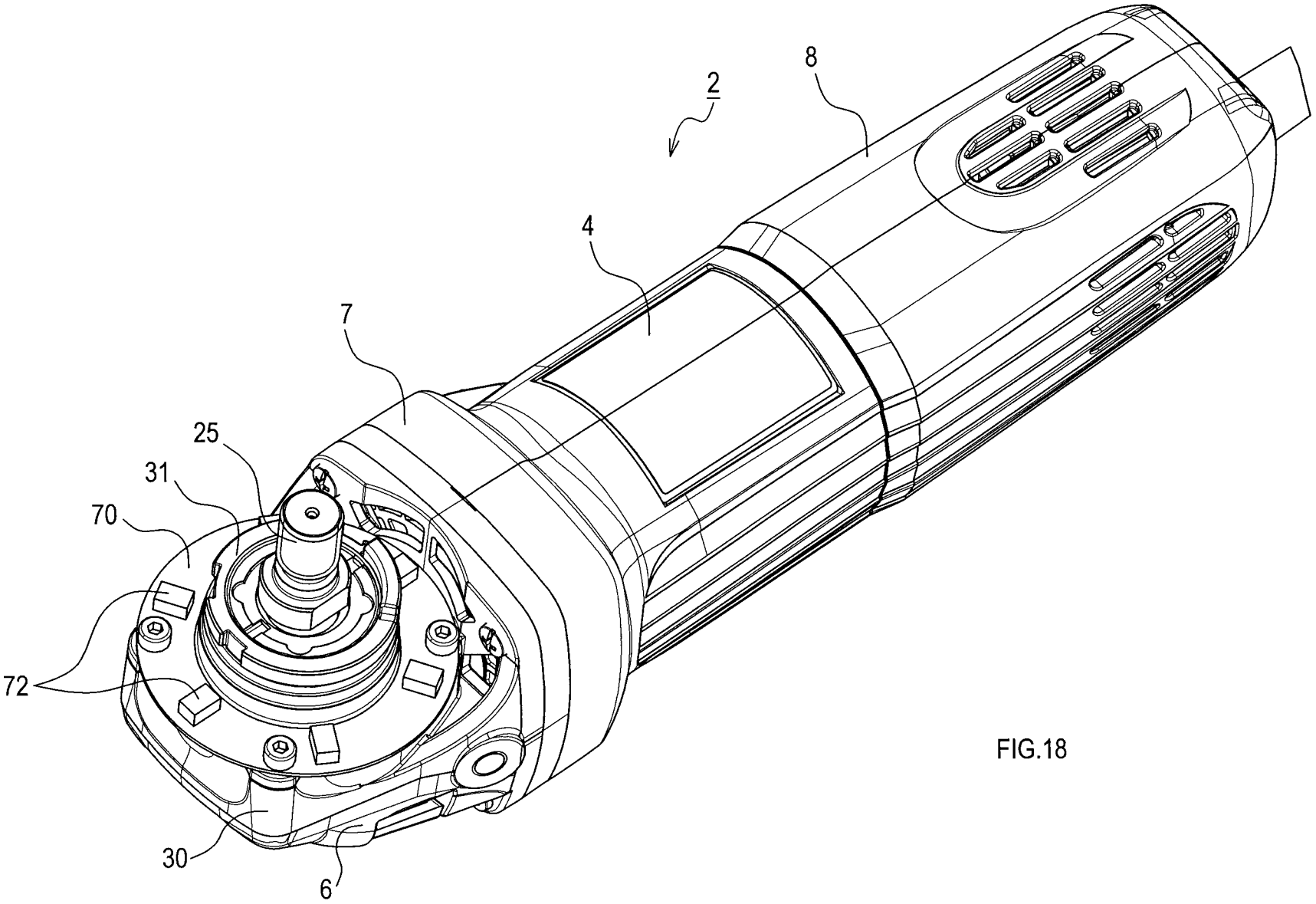
FIG. 18 is a perspective view illustrating a configuration of a spindle and a periphery thereof of a grinder according to a sixth embodiment.
Figure 19:
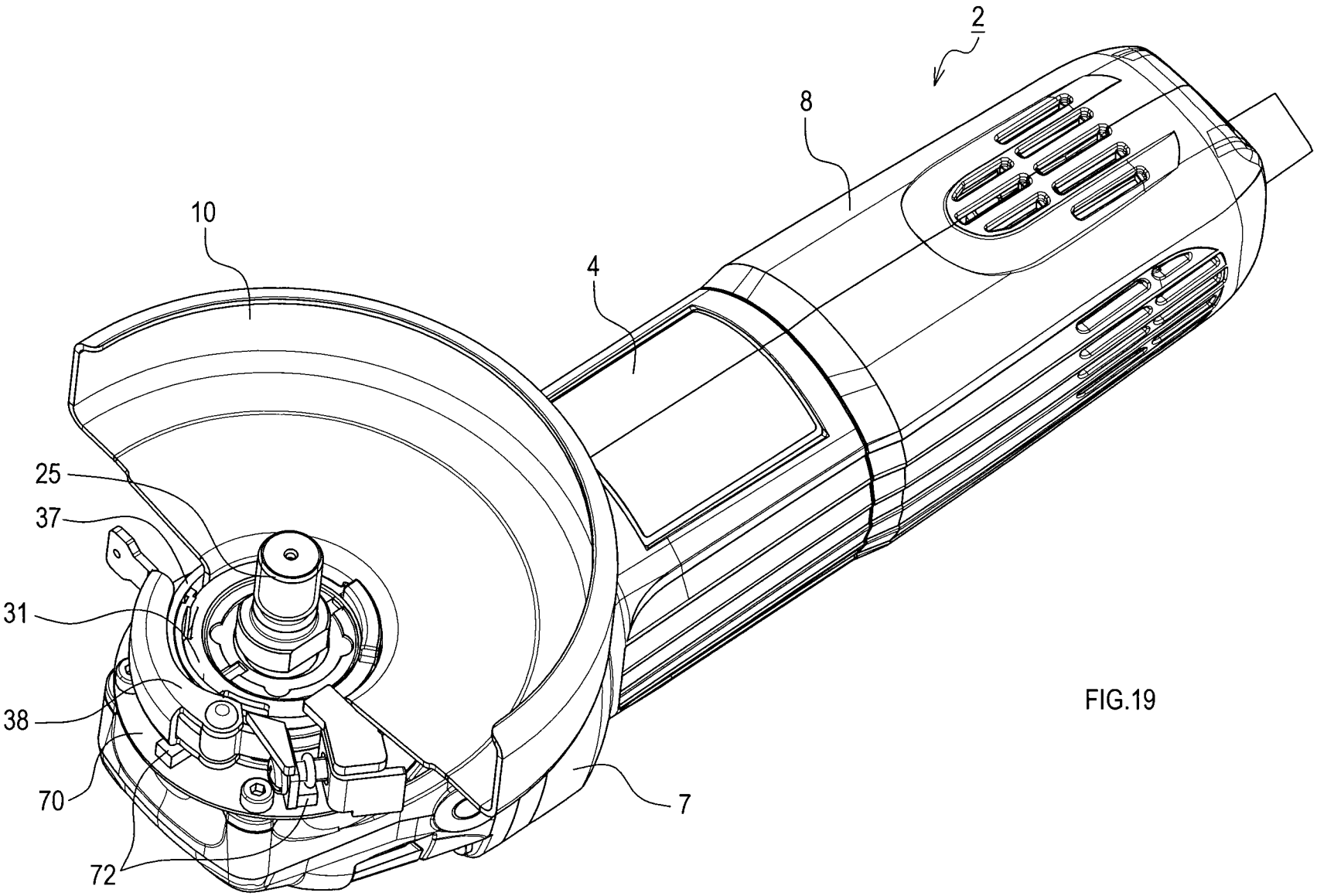
FIG. 19 is a perspective view illustrating a state in which a wheel cover is attached to the grinder illustrated in FIG. 18.

The grinder 2 according to the present embodiment has a similar basic configuration to that of the grinder 2 according to the first embodiment and differs from the grinder 2 according to the first embodiment in that a plurality of sensors 72 configured to detect the semi-circular plate of the wheel cover 10 is provided around the spindle 24 as illustrated in FIGS. 18 and 19. This respect will be described below. In FIGS. 18 and 19, similar components to those in the first embodiment are shown with the same reference numerals as mentioned above, and description of the duplicate components is omitted.

As illustrated in FIGS. 18 and 19, the plurality of sensors 72 is secured to a hollow circular plate 70, provided at a position opposed to the wheel cover 10 attached to the internal housing 30, around the spindle 24 in the internal housing 30.

The six sensors 72 are provided on the circular plate 70 approximately at regular intervals on a circle centering on the spindle 24. Each of the sensors 72 is configured to detect whether or not the wheel cover 10 exists on an opposite side of the circular plate 70 and includes an optical sensor, for example.

Thus, an output from each sensor 72 varies depending on whether or not the semi-circular plate of the wheel cover 10 exists in the detecting direction, and the cover detection circuit 96 can detect whether or not the wheel cover 10 exists based on a difference among the outputs from the respective sensors 72.

Also, the cover detection circuit 96 can detect an arranging position of the wheel cover 10 around the spindle 24 based on the arranging position of each sensor 72 and the output difference.

Thus, in the grinder 2 according to the present embodiment, the control circuit 90 can control the motor 12 in a similar procedure to the control process illustrated in FIG. 3 and can control rotation speed of the driven motor 12 based on the arranging position of the wheel cover 10.

Figure 20:
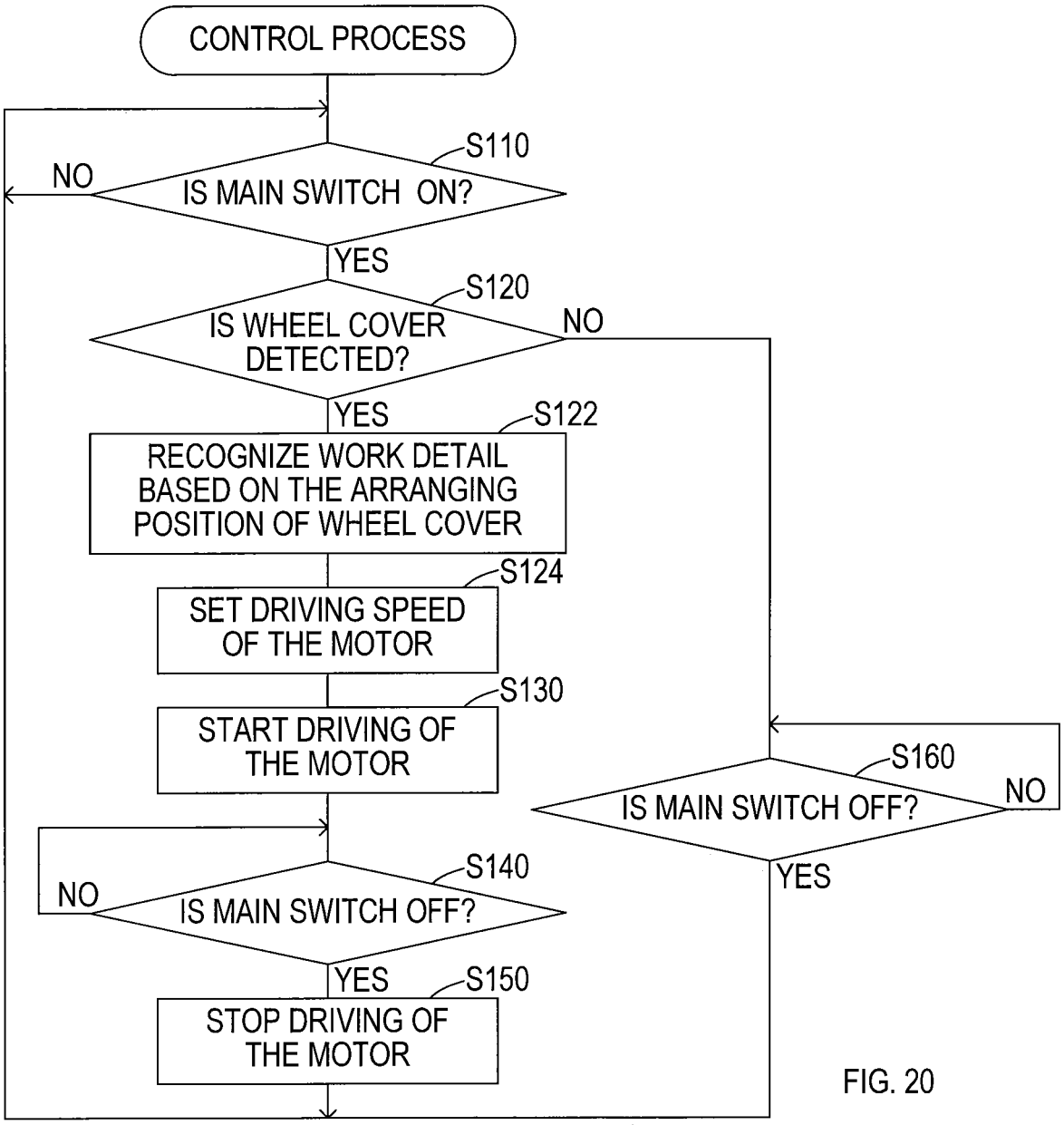
FIG. 20 is a flowchart illustrating a control process executed in a control circuit of the grinder according to the sixth embodiment.

To control rotation speed of the driven motor 12 based on the arranging position of the wheel cover 10, a control process may be executed in a procedure illustrated in FIG. 20.

That is, as illustrated in FIG. 20, when it is determined in S120 that the wheel cover 10 has been detected, an arranging position of the wheel cover 10 is read, and work detail is recognized based on the arranging position in S122. Subsequently, in S124, driving speed of the motor 12 is set in accordance with the recognized work detail, and the procedure moves to S130.

In this procedure, the user does not need to set driving speed of the motor 12 in accordance with the work detail. When the main switch 82 is turned on, the work detail is recognized, and driving speed of the motor 12 can automatically be set.

Fourth Modification Example

In each of the second, third, and sixth embodiments, the Hall sensor 54, the pressure sensor 56, or the sensors 72 serving as the detector is/are provided to the internal housing 30 to which the wheel cover 10 is attached.

Accordingly, although the sensors 54, 56, and 72 need to be coupled via the signal line 42 to the circuit board 50, and it is difficult to arrange the signal line 42 inside the gear housing 6 for the coupling.

Figure 21:
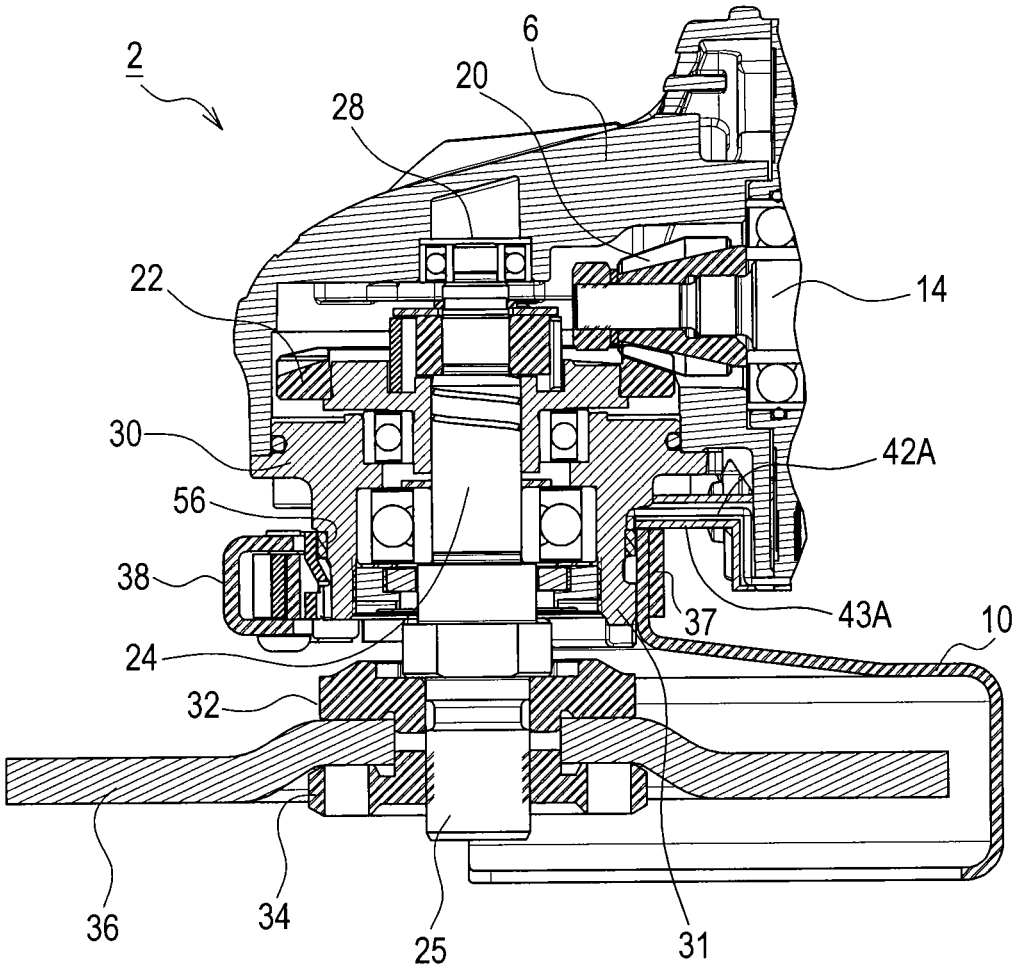
FIG. 21 is a cross-sectional view illustrating a configuration of a spindle and a periphery thereof of a grinder according to a fourth modification example.

Under such circumstances, as illustrated in FIG. 21, in a case in which the detector (in the drawing, the pressure sensor 56 according to the third embodiment) is provided to the internal housing 30, a signal line 42A coupled to the detector may be extracted outside the gear housing 6.

That is, the signal line 42A coupled to the detector is arranged outside the gear housing 6 and is coupled to the signal line 42 arranged inside the motor housing 4.

In this manner, the signal line 42 does not need to be arranged inside the gear housing 6, and a path for the line can easily be secured.

Also, in this case, the surrounding of the signal line 42A running outside the gear housing 6 from the detector and reaching the brake device 7 may be covered with a protection cover 43A.

Fifth Modification Example

In each of the first, fourth, and fifth embodiments, the metal sensor 40 or the micro switch 58 or 60 serving as the detector is provided to the outside wall of the motor housing 4 on the side of the gear housing 6 (more specifically, to the outside wall of the brake device 7). The signal line 42 coupled to the detector is arranged inside the brake device 7 and the motor housing 4 and is coupled to the circuit board 50 in the rear cover 8.

Thus, in each of the first, fourth, and fifth embodiments, a line arranging path for arranging the signal line 42 needs to be formed inside the brake device 7 and the motor housing 4. A configuration for the arrangement is complicated, and line arranging work of the signal line 42 is troublesome.

Figure 22A:
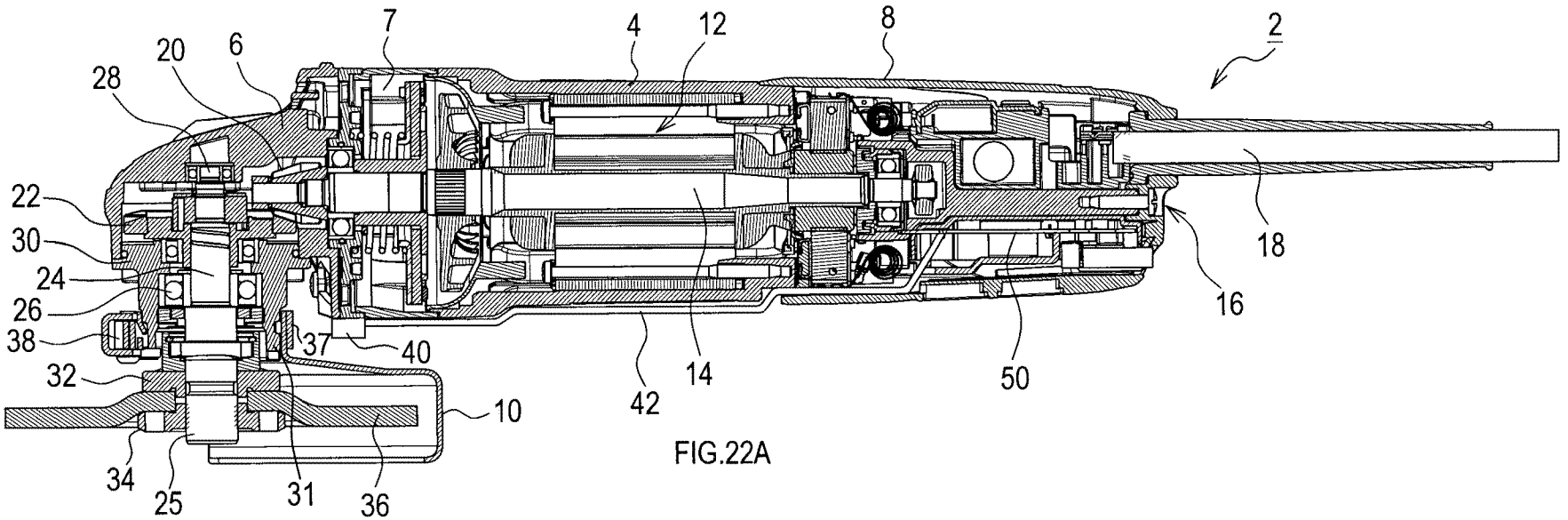
FIGS. 22A and 22B are cross-sectional views illustrating a configuration of a grinder according to a fifth modification example.

Under such circumstances, as illustrated in FIG. 22A, in a case in which the detector (in the drawing, the metal sensor 40 similar to one according to the first embodiment) is provided to the outside wall of the brake device 7, the signal line 42 coupled to the detector may be arranged on the outside wall of the brake device 7 and the motor housing 4.

That is, the signal line 42 is arranged on the outside wall of the brake device 7 and the motor housing 4 and is inserted into the rear cover 8 on the rear end side of the motor housing 4.

In this manner, the signal line 42 does not need to be arranged inside the brake device 7 and the motor housing 4. Accordingly, no line arranging path needs to be formed inside them, and line arranging work of the signal line 42 in each portion can be simplified.

Figure 22B:
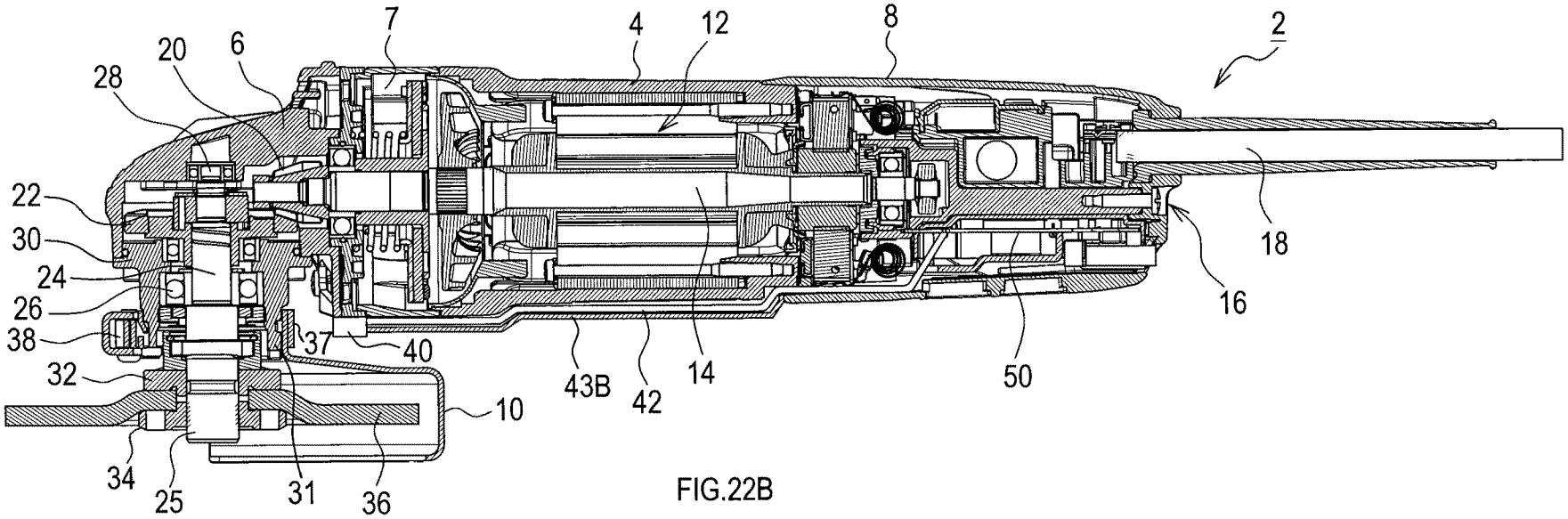

Also, in the case in which the signal line 42 is arranged on the outside wall of the brake device 7 and the motor housing 4, a protection cover 43B covering the signal line 42 from outside may be provided as illustrated in FIG. 22B.

In this case, a groove into which the signal line 42 is inserted and positioned may be formed on the outside wall of the grinder 2 on which the signal line 42 is arranged or on the inner side of the protection cover 43B. In this manner, it is possible to prevent the signal line 42 from being displaced in a position between the outside wall of the grinder 2 and the protection cover 43B. Accordingly, it is possible to inhibit the signal line 42 from being displaced and being deteriorated due to vibration of the grinder 2, for example.

Also, as in each of the first, fourth, and fifth embodiments, in a case in which the signal line 42 is arranged inside the brake device 7 and the motor housing 4, the signal line 42 may be inserted into a pipe or a groove for line arrangement to protect the signal line from vibration or the like of the grinder 2.

Sixth Modification Example

Figure 23A:
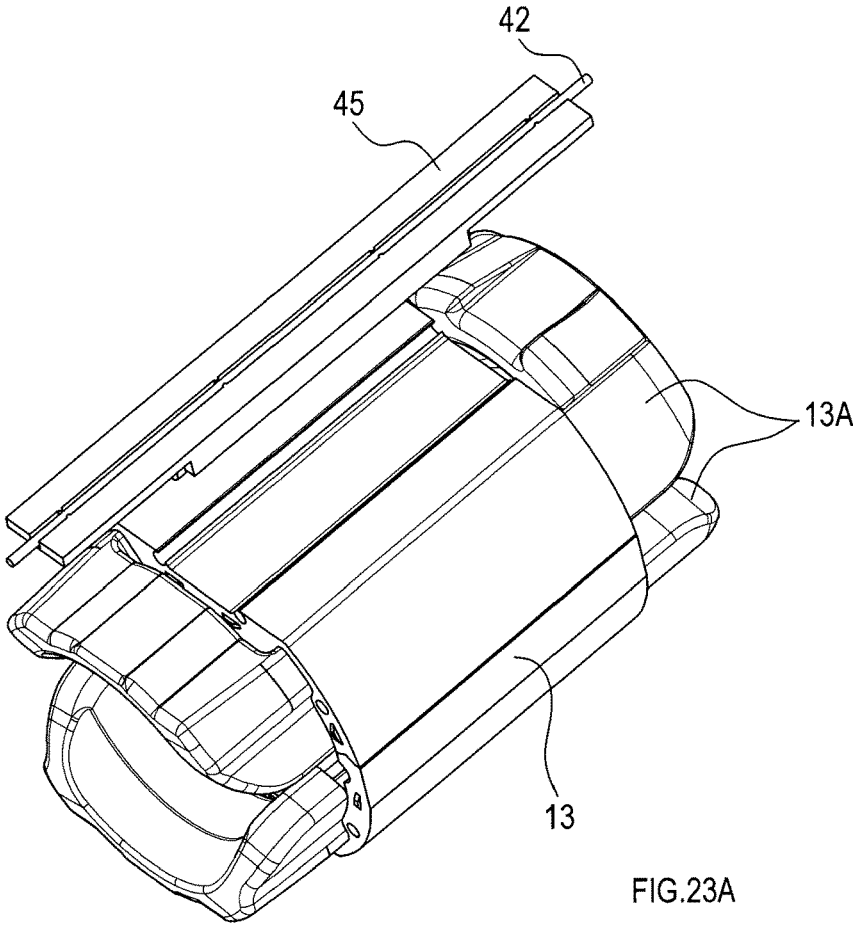
FIGS. 23A and 23B are perspective views illustrating a stator 13 of a motor 12 according to a sixth modification example.
Figure 23B:
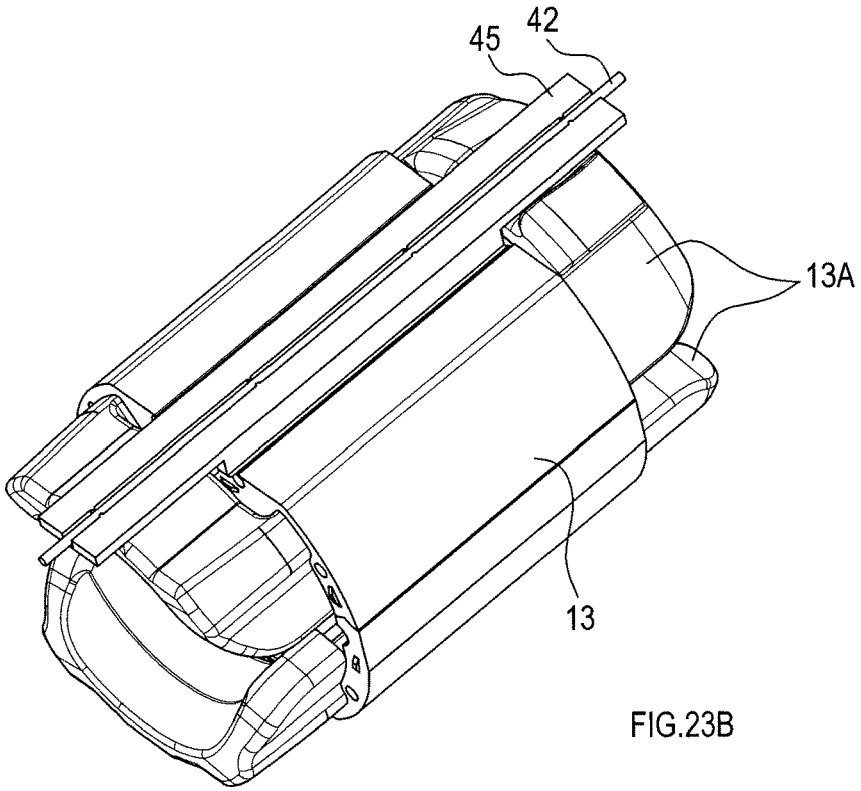

Also, as in each of the first, fourth, and fifth embodiments, in a case in which the signal line 42 is arranged inside the motor housing 4, the signal line 42 may be secured to an outside wall of a stator 13 of the motor 12 via a line arranging folder 45 as illustrated in FIGS. 23A and 23B.

That is, around the rotation shaft 14 in the motor 12, a motor winding 13A is wound, and a stator 13 secured by an adhesive or the like is arranged. The motor 12 is slid along the direction of the center axis of the motor housing 4 so that the outer circumferential surface of the stator 13 and the inner circumferential surface of the motor housing 4 contact each other and is thus secured inside the motor housing 4.

As illustrated in FIG. 23A, the signal line 42 is inserted into a groove of the folder 45 configured to be attachable to the outside wall of the stator 13 of the motor 12, and the folder 45 is attached to the outside wall of the stator 13. As a result, as illustrated in FIG. 23B, the signal line 42 is secured to the motor 12 via the folder 45.

In this manner, by housing inside the motor housing 4 the motor 12 in which the signal line 42 is secured to the outside wall of the stator 13, line arranging work can be simplified even in a case in which the signal line 4 is arranged inside the motor housing 4.

Figure 24:
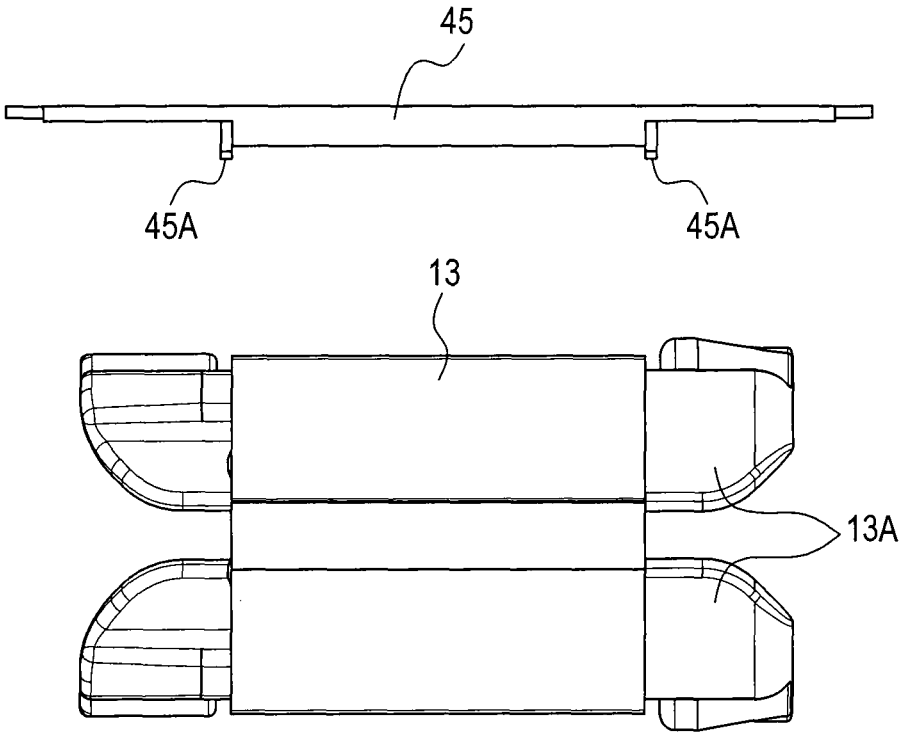
FIG. 24 is a side view illustrating the stator 13 and the folder 45 illustrated in FIGS. 23A and 23B.

The signal line 42 needs to be arranged along the motor housing 4 in the direction of the center axis of the motor housing 4. Thus, as illustrated in FIG. 24, the folder 45 may be formed in an elongated shape elongated along the direction of the center axis, and the length of the folder 45 may be set to be equal to or slightly longer than the length of the entire motor 12 including the motor winding 13A protruding from the stator 13.

Also, to prevent the folder 45 from being displaced along the direction of the center axis in the motor housing 4, the folder 45 may be provided on an opposed side thereof to the stator 13 with engaging protrusions 45A configured to be engaged with both ends of the stator 13 along the direction of the center axis and to position the folder 45 with respect to the stator 13.

Seventh Embodiment

In the aforementioned first to sixth embodiments and first to sixth modification examples, the detector and the circuit board 50 are described to be coupled via the signal line 42. However, arranging the signal line 42 is troublesome.

Figure 25:
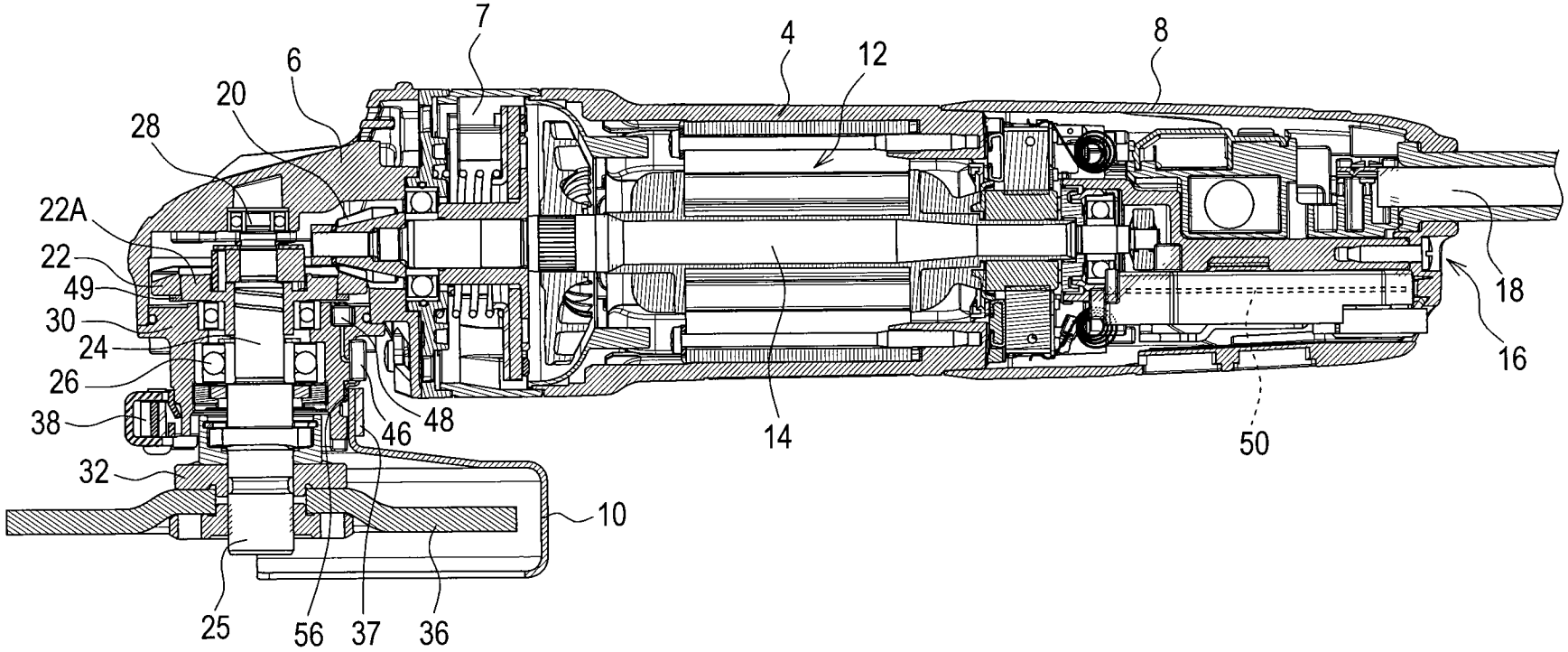
FIG. 25 is a cross-sectional view illustrating a configuration of a grinder according to a seventh embodiment.

Under such circumstances, as illustrated in FIG. 25, a transmitter 46 configured to transmit a detection signal wirelessly may be provided close to (or inside) the detector (in the drawing, the pressure sensor 56 according to the third embodiment), and the control circuit 90 may determine whether or not the wheel cover 10 exists based on a transmission signal transmitted from the transmitter 46.

A grinder configured as mentioned above will be described as a seventh embodiment of the present disclosure.

As illustrated in FIG. 25, in the grinder according to the seventh embodiment, the pressure sensor 56 serving as the detector is provided to the internal housing 30. Thus, the transmitter 46 is provided on the outside wall of the housing (in the drawing, the internal housing 30) close to the pressure sensor 56.

Also, the transmitter 46 is configured to receive a detection signal from the pressure sensor 56 and transmit the detection signal wirelessly. Hence, to operate the transmitter 46, the transmitter 46 needs to be supplied with an electric power. In order to supply the electric power, a battery may be incorporated in the transmitter 46.

However, in the present embodiment, since the transmitter 46 is secured to the internal housing 30 configured to rotatably support the spindle 25, the internal housing 30 is provided with a power generator 48 configured to electric generate power due to rotation of the spindle 25 and to supply an electric power to the transmitter.

The power generator 48 includes a so-called pickup coil configured to detect magnets 49 rotated along with rotation of the spindle 24.

Figure 26:
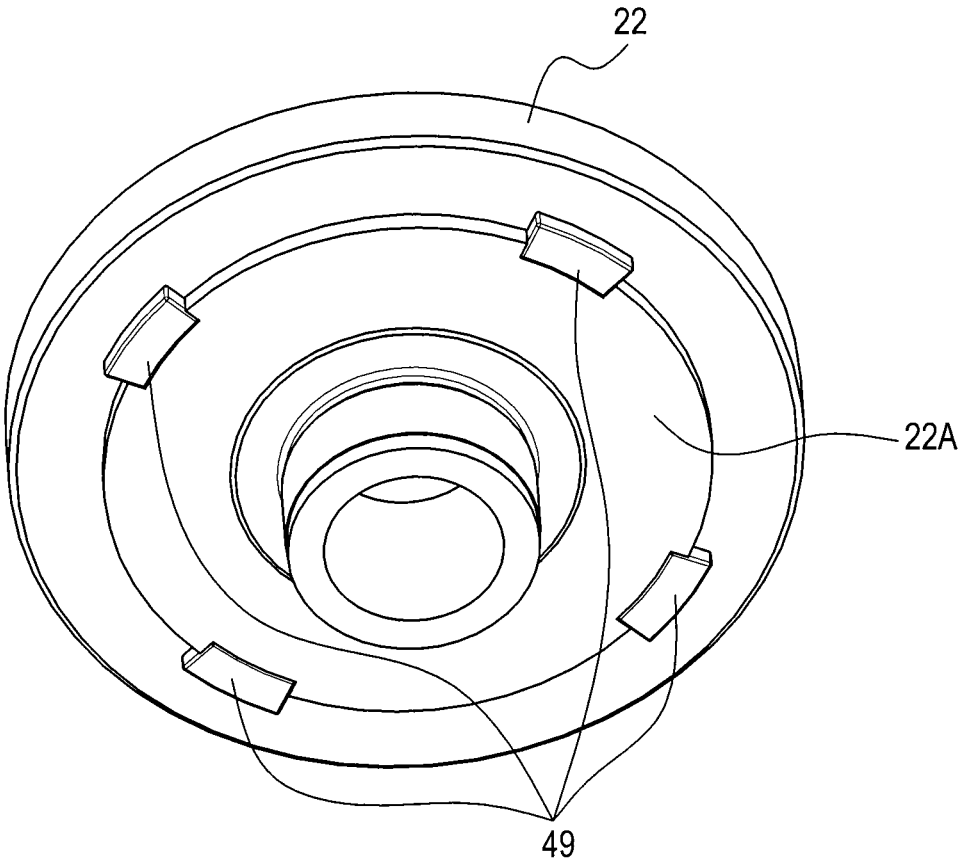
FIG. 26 is a perspective view illustrating a bevel gear main body to which magnets for electric power generation are attached.

Specifically, as illustrated in FIG. 26, the magnets 49 are provided on a rear surface of a hollow circular-plate-shaped bevel gear main body 22A, which is an opposite side of a surface provided at an outer circumferential part thereof with the second bevel gear 22.

The spindle 25 is inserted in the hollow portion of the bevel gear main body 22A to cause the bevel gear main body 22A to be secured to the spindle 25 and to be rotated together with the spindle 25. A plurality of (four in the drawing) magnets 49 are provided around the spindle 25 at specific angular intervals (intervals of 90 degrees in the drawing).

Figure 27A:
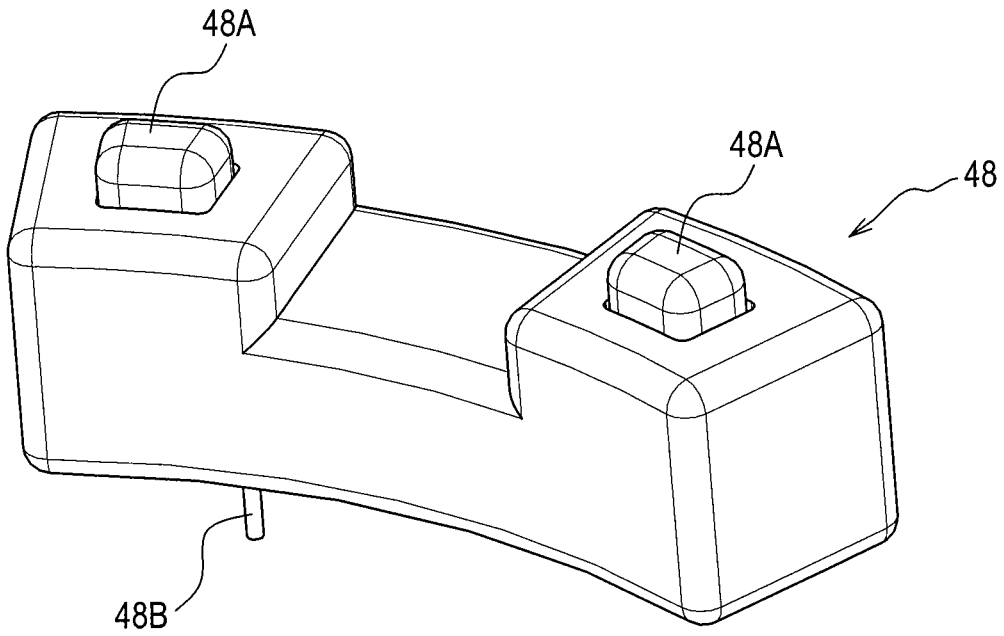
FIGS. 27A and 27B are perspective views illustrating a configuration of a power generator.
Figure 27B:
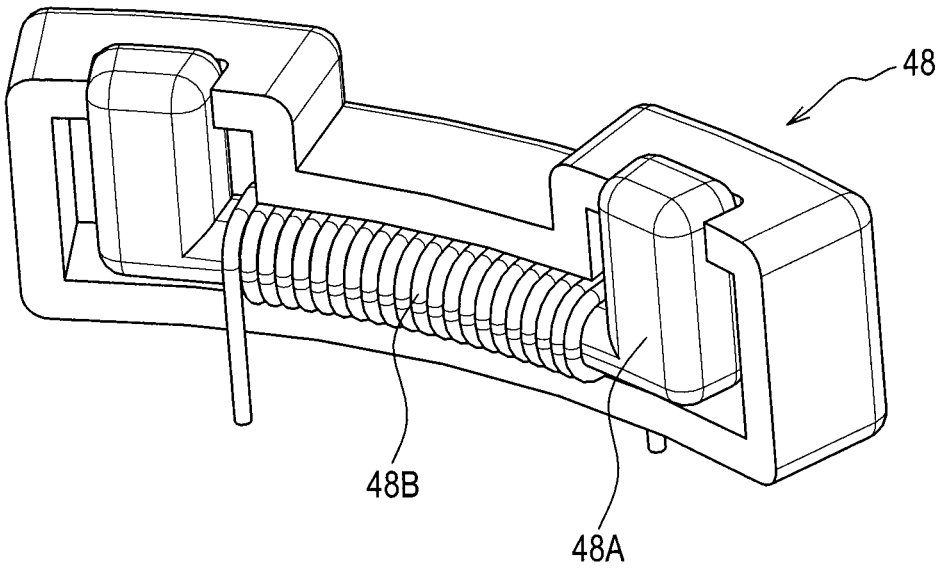

On the other hand, the power generator 48 includes an iron core 48A whose ends protrude toward the bevel gear main body 22A so that the ends may face a moving path of the magnets 49 along with rotation of the spindle 25, and a coil 48B wound around the iron core 48A as illustrated in FIG. 27B.

A main body part of the iron core 48A around which the coil 48B is wound (that is, the power generator 48) is housed in a case made of synthetic resin and is secured to the internal housing 30 as illustrated in FIG. 27A.

Consequently, an alternating electric power is generated at both ends of the coil 48B by rotation of the spindle 28, and the alternating electric power is supplied to the transmitter 46.

The transmitter 46 rectifies the alternating electric power supplied from the power generator 48 and generates a direct electric power for driving of an internal transmission circuit. Since this configuration is publicly known, detailed description thereof will be omitted herein.

Figure 28:
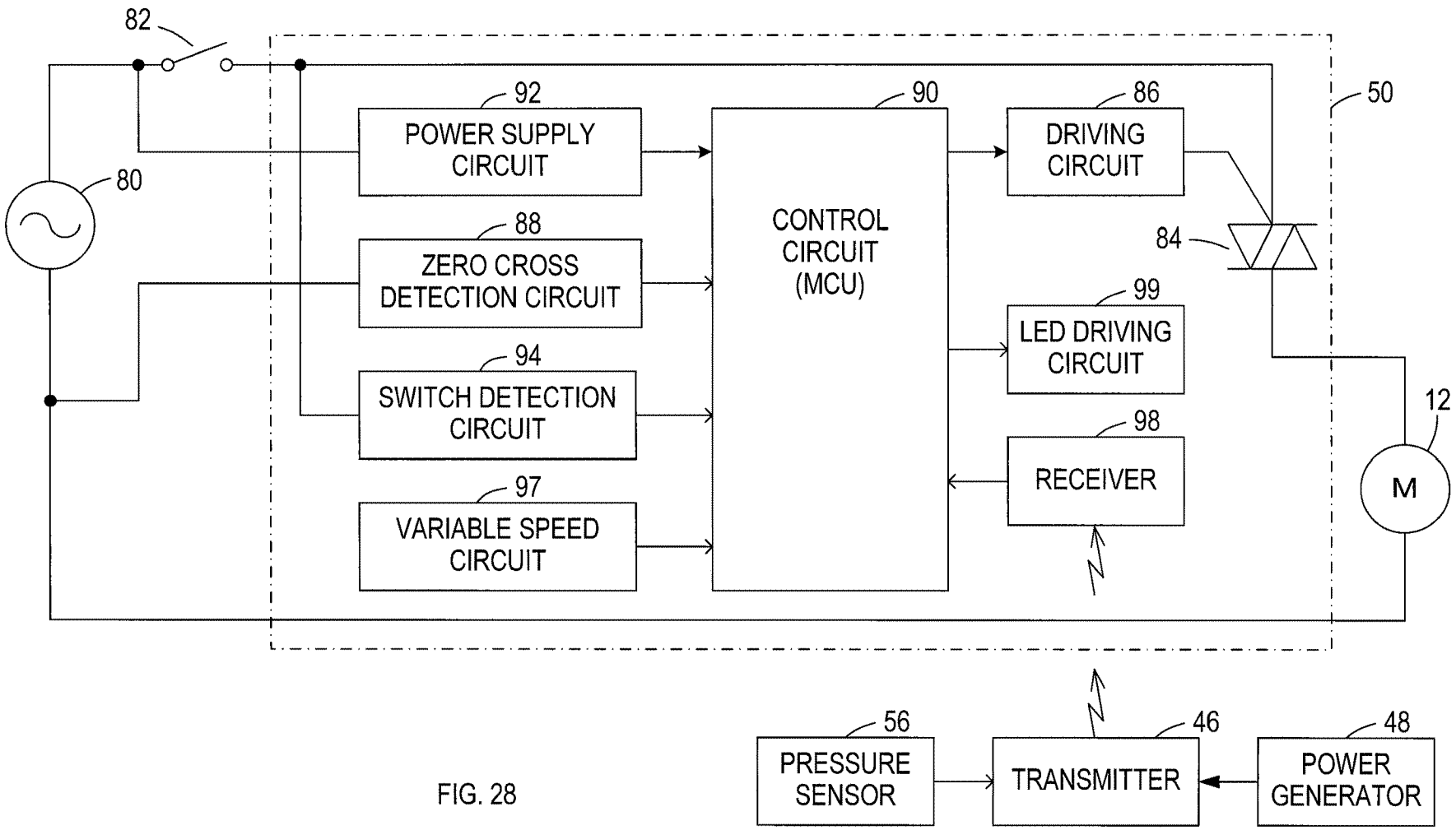
FIG. 28 is a block diagram illustrating a configuration of an entire control system of the grinder according to the seventh embodiment.

As illustrated in FIG. 28, the circuit board 50 according to the present embodiment is provided with a receiver 98 configured to receive a transmission signal from the transmitter 46 instead of the cover detection circuit 96 in the circuit board 50 illustrated in FIG. 2.

The transmitter 46 and the receiver 98 may be configured as wireless communicators enabling two-way communication to be performed as long as the transmitter 46 and the receiver 98 can wirelessly transmit and receive a detection signal detected by the detector such as the pressure sensor 56. Also, the circuit board 50 illustrated in FIG. 28 includes a variable speed circuit 97 configured to set rotation speed at the time of driving of the motor 12 and an LED driving circuit 99 configured to display an operation state of the grinder.

Figure 29:
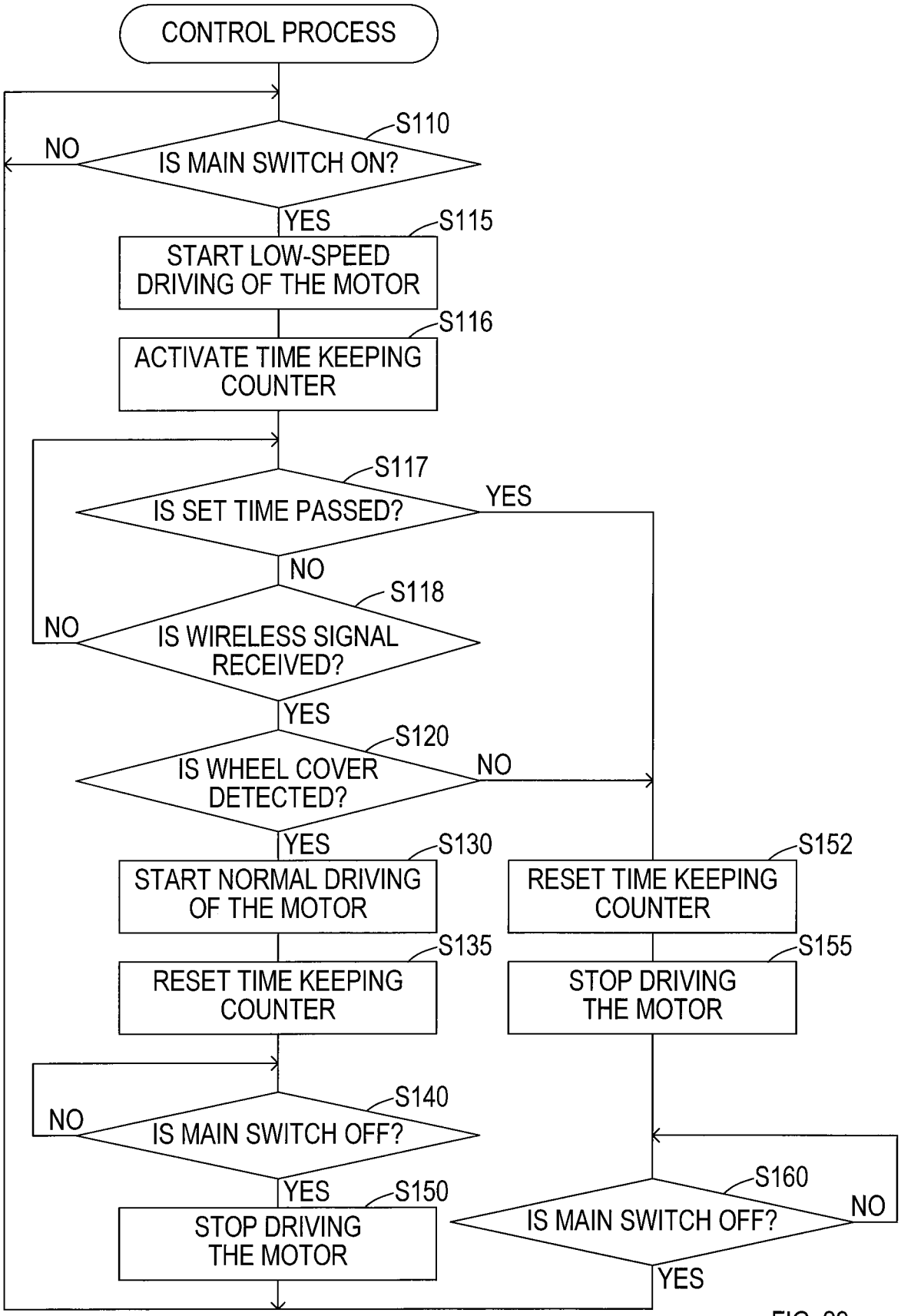
FIG. 29 is a flowchart illustrating a control process executed in a control circuit in FIG. 28.

The control circuit 90 executes a control process in a procedure illustrated in a flowchart in FIG. 29.

In the control process according to the present embodiment, when it is determined in S110 that the main switch 82 is in an on-state, the procedure moves to S115, and low-speed driving of the motor 12 is started. The process in S115 is a process of rotating the motor 12 at low speed to rotate the spindle 25 so that the power generator 48 can generate an electric power required to operate the transmitter 46.

When the low-speed driving of the motor 12 is started in S115, the procedure moves to S116 to activate a time keeping counter starts time keeping after start of the low-speed driving.

Subsequently, in S117, it is determined based on the value of the time keeping counter whether or not set time has passed since the start of the low-speed driving of the motor 12. In a case in which the set time has not passed, the procedure moves to S118, and it is determined whether or not the receiver 98 has received a wireless signal transmitted from the transmitter 46.

In a case in which it is determined in S118 that a wireless signal is received, the procedure moves to S120. In a case in which it is determined in S118 that no wireless signal is received, the procedure moves to S117.

In S120, it is determined whether or not the pressure sensor 56 serving as the detector has detected the wheel cover 10 based on the wireless signal (reception signal) received in the receiver 98. In a case in which the wheel cover 56 is detected, normal driving of the motor 12 is started in S130, the time keeping operation by the time keeping counter is stopped in S135 to reset the time keeping, and the procedure moves to S140.

In S140, the control circuit 90 waits until the main switch 82 is turned off in a similar manner to that of the aforementioned control process. When the main switch 82 is turned off, driving of the motor 12 is stopped in S150, and the procedure moves to S110.

When it is determined in S120 that the wheel cover 56 is not detected, or when it is determined in S117 that the set time has passed, the procedure moves to S152 to stop the time keeping operation of the time keeping counter and reset the time keeping and moves to S155.

Driving of the motor 12 is stopped in S155, and the control circuit 90 waits until the main switch 82 is turned off in subsequent S160. When it is determined in S160 that the main switch 82 is turned off, the procedure moves to S110.

In the grinder according to the present embodiment configured as mentioned above, since a detection result of the wheel cover 56 detected by the pressure sensor 56 serving as the detector can be transmitted to the control circuit 90 wirelessly, the signal line 42 can be dispensed with.

Also, since an electric power can be supplied to the transmitter 46 from the power generator 48 configured to generate an electric power due to rotation of the spindle 25, no battery needs to be incorporated in the transmitter 46, and it is possible to inhibit the transmitter 46 from stopping operation due to discharge of a battery.

Seventh Modification Example

Although, in the seventh embodiment, the transmitter 46 is described to be configured to transmit a detection signal from the pressure sensor 56 wirelessly, the transmitter 46 may be provided to the metal sensor 40 according to the first embodiment and transmit a detection signal from the metal sensor 40 wirelessly as illustrated by the dotted line in FIG. 1. Also, the transmitter 46 may be provided to the detector used in another embodiment or modification example.

As in a case of the metal sensor 40 and the transmitter 46 illustrated in FIG. 1, in a case in which the detector and the transmitter 46 are provided to the brake device 7 or the motor housing 4, it is difficult to supply an electric power to the transmitter 46 from the power generator 48 configured to generate an electric power due to rotation of the spindle 24.

In this case, a battery may be incorporated in the transmitter 46, or a power generator configured to generate power due to vibration of the grinder with use of a piezoelectric element or the like may be provided.

Other Modification Examples

The embodiments and modification examples according to the present disclosure have been described above. However, the grinder according to the present disclosure is not limited to one according to each of the aforementioned embodiments and modification examples and can be modified in various ways.

For example, although, in the first to fifth embodiments, the seventh embodiment, and the modification examples thereof, one sensor is used as the detector, a plurality of sensors may be provided to be distributed around the spindle as in the sixth embodiment. This enables not only whether or not the wheel cover 10 exists but also the arranging position of the wheel cover 10 to be detected. Accordingly, the control circuit 90 can execute the control process illustrated in FIG. 20

Also, in the above embodiments, when the wheel cover 10 is not detected, the motor 12 is not driven even when the main switch 82 is turned on. However, in this case, driving of the motor 12 may be restricted.

Specifically, the motor 12 may be driven at low speed, or the motor 12 may be driven so that rotation of the motor 12 fluctuates. By doing so, when the wheel cover 10 is detached from the grinder 2, the user cannot use the grinder 2 in a normal manner, which enables the object of one aspect of the present disclosure to be achieved.

Also, although the main switch 82 is a sliding switch in the above embodiments, the main switch 82 may be a toggle switch, a paddle switch, a trigger switch, or the like.

Also, although the wheel cover 10 is held at the internal housing 30 provided with the spindle 24 in the above embodiments, the wheel cover 10 may be held at the gear housing 6 in which the internal housing 30 is housed.

Also, the gear housing 6 may be integrated with the internal housing 30, and the spindle 24, the first bevel gear 20, the second bevel gear 22, the bearings 26 and 28, and the like may be provided directly to the gear housing 6.

Also, a plurality of functions included in one component of each of the above embodiments may be achieved by a plurality of components, and one function included in one component may be achieved by a plurality of components. Also, a plurality of functions included in a plurality of components may be achieved by one component, and one function achieved by a plurality of components may be achieved by one component. Also, components of each of the above embodiments may partially be omitted. Also, at least some of components of one embodiment described above may be added to or substituted with components of another embodiment described above. All aspects included in the technical idea specified merely by wording of the patent claims are embodiments of the present disclosure.

The invention claimed is:

1. A grinder comprising:

a motor;

a housing for housing the motor;

a spindle protruding from the housing, the spindle being configured to be rotated by the motor, and the spindle being configured to be attached to a tip end tool with a surface of the tip end tool facing the housing;

a wheel cover detachably attached to the housing and configured to cover a part of the tip end tool;

a detector configured to detect the wheel cover attached to the housing, and directly face the surface of the tip end tool or face the surface such that the wheel cover is interposed therebetween; and a controller configured to stop or restrict the spindle in response to non-detection of the wheel cover by the detector.

2. The grinder according to claim 1, wherein the detector is configured to detect the wheel cover without contacting the wheel cover.

3. A grinder comprising:

a motor;

a housing for housing the motor;

a spindle protruding from the housing and configured to be driven to be rotated by the motor in the housing;

a wheel cover detachably attached to the housing to cover a part of a tip end tool that is attached to the spindle;

at least one detector configured to detect the wheel cover attached to the housing; and a controller configured to stop or restrict the spindle being driven by the motor in response to non-detection of the wheel cover by the detector, wherein the at least one detector is configured to detect the wheel cover without contacting the wheel cover, wherein the wheel cover is made of a magnetic body and includes an attaching portion to be attached to the housing, and wherein the at least one detector includes a magnet and a Hall sensor arranged to be spaced apart from each other along an attaching part of the housing to which the attaching portion of the wheel cover is attached.

4. The grinder according to claim 1, wherein the detector is configured to contact the wheel cover directly or via an intermediate member to thereby detect the wheel cover.

5. The grinder according to claim 4, wherein the detector includes a switch configured to change on and off states in response to contacting the wheel cover directly or via the intermediate member.

6. A grinder comprising:

a motor;

a housing for housing the motor;

a spindle protruding from the housing and configured to be driven to be rotated by the motor in the housing;

a wheel cover detachably attached to the housing to cover a part of a tip end tool that is attached to the spindle;

at least one detector configured to detect the wheel cover attached to the housing; and a controller configured to stop or restrict the spindle being driven by the motor in response to non-detection of the wheel cover by the detector, wherein the at least one detector is configured to contact the wheel cover directly or via an intermediate member to thereby detect the wheel cover, wherein the wheel cover includes an attaching portion to be attached to the housing, and wherein the at least one detector includes a pressure sensor provided at an attaching part of the housing to which the wheel cover is attached via the attaching portion.

7. The grinder according to claim 6, wherein the attaching part of the housing is an outer circumference of a protruding part of the spindle formed to surround the spindle, the attaching portion of the wheel cover is in an annular shape that is fittable onto the attaching part of the housing and includes a projection provided at a specified portion on an inner circumferential surface of the annular shape, and the pressure sensor is provided at the outer circumference of the attaching part in a continuous or distributed manner to enable a position of the projection to be detected at the attaching part.

8. The grinder according to claim 1, further comprising:

a second detector disposed at a different position of the housing than the detector.

9. The grinder according to claim 1, wherein the controller is provided in the housing and is coupled to the detector via a signal line.

10. The grinder according to claim 9, wherein at least a part of the signal line is arranged outside the housing, the grinder comprising:

a protection cover configured to cover the signal line arranged outside the housing.

11. The grinder according to claim 9, wherein the signal line is arranged outside a stator of the motor and is housed in the housing together with the motor.

12. A grinder comprising:

a motor;

a housing for housing the motor;

a spindle protruding from the housing and configured to be driven to be rotated by the motor in the housing;

a wheel cover detachably attached to the housing to cover a part of a tip end tool that is attached to the spindle;

at least one detector configured to detect the wheel cover attached to the housing;

a controller configured to stop or restrict the spindle being driven by the motor in response to non-detection of the wheel cover by the detector; and a transmitter configured to transmit a detection result provided by the at least one detector to the controller wirelessly, wherein the controller is configured to receive a transmission signal from the transmitter to obtain the detection result.

13. The grinder according to claim 12, comprising:

a power generator configured to generate an electric power due to rotation of the motor or the spindle or vibration of the grinder, wherein the transmitter is configured to receive the electric power from the power generator and to operate.

14. The grinder according to claim 1, wherein the detector is provided to the housing.

* * * * *